US008814157B2

(12) United States Patent
Gamo

(10) Patent No.: US 8,814,157 B2
(45) Date of Patent: Aug. 26, 2014

(54) SHEET PROCESSING APPARATUS AND IMAGE FORMING APPARATUS

(75) Inventor: Yohei Gamo, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/615,050

(22) Filed: Sep. 13, 2012

(65) Prior Publication Data

US 2013/0082436 A1 Apr. 4, 2013

(30) Foreign Application Priority Data

Sep. 30, 2011 (JP) ..... 2011-216976
Sep. 4, 2012 (JP) ..... 2012-193981

(51) Int. Cl.
*B65H 33/04* (2006.01)

(52) U.S. Cl.
USPC ..... 271/3.02; 271/233; 270/58.12

(58) Field of Classification Search
USPC ..... 271/3.02, 233; 270/58.12, 58.16, 58.17, 270/58.27
See application file for complete search history.

(56) References Cited

U.S. PATENT DOCUMENTS 6,241,234 B1 * 6/2001 Saitoh et al. ..... 270/58.12
7,248,829 B2 * 7/2007 Kobayashi ..... 399/410
7,296,788 B2 * 11/2007 Terao et al. ..... 270/58.08
7,578,497 B2 * 8/2009 Kawata et al. ..... 270/37
7,703,758 B2 * 4/2010 Kamiya et al. ..... 270/58.09
7,717,414 B2 * 5/2010 Ooshiro ..... 270/58.27
7,731,169 B2 * 6/2010 Saito ..... 270/58.12
7,780,159 B2 * 8/2010 Nishimura et al. ..... 270/58.11
7,900,905 B2 * 3/2011 Kiriyama ..... 270/58.1
7,900,912 B2 * 3/2011 Moriyama et al. ..... 271/220
7,946,568 B2 * 5/2011 Hayashi et al. ..... 270/58.11
7,976,004 B2 * 7/2011 Kimura ..... 270/58.11
8,123,209 B2 * 2/2012 Kubota et al. ..... 270/58.07
8,136,812 B2 * 3/2012 Yamashita ..... 271/265.01
8,141,863 B2 * 3/2012 Nakamura et al. ..... 270/58.13

FOREIGN PATENT DOCUMENTS

JP 10-194582 A 7/1998

* cited by examiner

*Primary Examiner* — Jeremy R Severson
(74) *Attorney, Agent, or Firm* — Canon USA, Inc., IP Division

(57) ABSTRACT

A sheet processing apparatus includes a sheet stacking unit where sheets to be processed are stacked, a regulating member, a sheet waiting unit, a first moving unit, a second moving unit, and a control unit. The regulating member abuts on one edge of sheets conveyed to the sheet stacking unit. The sheet waiting unit keeps sheets waiting, stacks the waiting sheets displaced sequentially, and then conveys the sheets to the sheet stacking unit. The first moving unit sequentially moves the conveyed sheets, starting from a lowermost sheet, to be abutted against the regulating member. The second moving unit moves the conveyed sheets to the first moving unit. The control unit controls a moving speed of the second moving unit so that a next sheet does not reach the first moving unit until the sheet moved by the first moving unit is abutted against the regulating member.

18 Claims, 20 Drawing Sheets

SHEET PROCESSING APPARATUS AND IMAGE FORMING APPARATUS

BACKGROUND OF THE INVENTION

1. Field of the Invention

The present invention relates to a sheet processing apparatus and an image forming apparatus, and, in particular, to a configuration for aligning subsequent sheets in a waiting state while prior sheets are processed.

2. Description of the Related Art

Conventionally, some image forming apparatuses, such as copying machines, laser beam printers, facsimile apparatuses, and multifunction peripherals having these functions, are provided with sheet processing apparatuses, which perform processing such as binding and sorting sheets with images formed thereon. A widely used type of such sheet processing apparatuses is an apparatus including an intermediate processing tray within the apparatus, and configured to stack a plurality of sheets on this intermediate processing tray to form a sheet bundle and then perform processing such as binding on this sheet bundle.

This kind of sheet processing apparatus requires a certain processing time to perform binding of sheets. Although this processing time partially depends on the image formation speed of the image forming apparatus, generally, the processing time exceeds an interval between discharges of sheets because it is difficult to complete binding processing within the interval between discharges of sheets. Therefore, binding processing requires an interruption of image formation, but this interruption of image formation reduces the productivity.

Therefore, some of conventional sheet processing apparatuses perform buffering processing (waiting processing), according to which, for example, first several sheets of a subsequent sheet bundle is temporarily kept waiting while binding processing is performed on a prior sheet bundle on the intermediate processing tray. Then, upon completion of the binding processing on the prior sheet bundle, the prior sheet bundle is discharged, and after that, the several sheets temporarily kept waiting are conveyed onto the intermediate processing tray in a stacked state. As a result, the sheets can be processed without an interruption of the image formation.

However, if an image forming apparatus can form images at a high speed and discharge sheets at short intervals, it is difficult to complete not only binding processing but also even alignment processing within the interval between discharges of sheets. One technique for solving this problem is a sheet processing apparatus that buffers sheets, which conventionally used to be conveyed to the intermediate processing tray one by one, and conveys a plurality of sheets to the intermediate processing tray at a time, thereby aligning the sheets without interrupting an output from the image forming apparatus (refer to Japanese Patent Application Laid-Open No. 10-194582).

In this conventional sheet processing apparatus, when sheets are processed, while binding processing is performed on a prior sheet bundle on the intermediate processing tray first, a first sheet in a subsequent sheet bundle is wound around a buffer roller to be set in a temporary waiting state. Then, when a second sheet reaches the buffer roller, the rotation of the temporarily stopped buffer roller is restarted, thereby overlapping the first sheet wound around the buffer roller with the second sheet. At this time, the first sheet and the second sheet are overlapping in such a manner that the upstream edge of the second sheet in the conveyance direction is ahead of the upstream edge of the first sheet in the conveyance direction by a predetermined distance in the conveyance direction. Thereafter, a predetermined number of sheets are overlapping in a similar manner so that the upstream edge of the upper sheet in the conveyance direction is ahead of the upstream edge of the lower sheet in the conveyance direction by the predetermined distance in the conveyance direction.

After that, upon completion of the binding processing on the prior sheet bundle and a discharge of the prior sheet bundle, the bundle of the overlapping sheets is discharged onto the intermediate processing tray by discharge rollers, and is transferred to bundle discharge rollers. Then, the trailing edge of the sheet bundle exits the discharge rollers, and at this time, the bundle discharge rollers in pressure contact with each other are rotated in the reverse direction. After that, the bundle discharge rollers are separated, whereby the sheet bundle is released in such a direction that the sheet bundle abuts on a trailing edge stopper of the intermediate processing tray.

On the other hand, this sheet processing apparatus includes a knurled belt for moving the sheet bundle in the direction toward the trailing edge stopper. Then, after the sheet bundle is released, the sheet processing apparatus brings the sheet bundle, in which the plurality of sheets is stacked in such a state that the upstream edges of the sheets are displaced in the conveyance direction, into contact with the trailing edge stopper by the knurled belt one by one sequentially, starting from the lowermost sheet, thereby aligning the discharged sheet bundle in the discharge direction. After that, the sheet bundle is aligned in the width direction perpendicular to the sheet discharge direction on the intermediate processing tray by an alignment plate (not illustrated), thereby completing the sheet alignment processing.

In this way, it is possible to align sheets without slowing down the processing speed of the image forming apparatus that form images at a high speed and discharges sheets at short intervals, by conveying the plurality of sheets onto the intermediate processing tray in a stacked and displaced state.

In such a conventional sheet processing apparatus, a plurality of sheets is stacked in such a manner that the upstream edges of the sheets in the conveyance direction are displaced by substantially equal distances. However, actually, a variation occurs in the distance by which the upstream edges of the sheets in the conveyance direction are displaced due to the influence of, for example, a conveyance error or a variation in the lengths of the sheets in the conveyance direction. If the stacked sheets are discharged with their upstream edges in the conveyance direction displaced by a distance shorter than a predetermined distance, the upstream edge of the upper sheet may reach the knurled belt before the upstream edge of the lower sheet in the conveyance direction is pulled into contact with the trailing edge stopper by the knurled belt. This is because the frictional coefficient between the knurled belt and the sheet is significantly larger than the frictional coefficient between the sheets, so the upper sheet is moved in a sliding contact with the upper surface of the lower sheet to reach the trailing edge stopper before the lower sheet.

Further, the knurled belt is configured to be abutted against the trailing edge stopper while in contact with the upper surface of a sheet. Therefore, if the upper sheet reaches the trailing edge stopper before the lower sheet reaches there, the lower sheet stops before reaching the trailing edge stopper, making excellent sheet alignment difficult.

SUMMARY OF THE INVENTION

The present invention is directed to providing a sheet processing apparatus and an image forming apparatus capable of ensuring that a plurality of stacked sheets can be aligned even if there is a conveyance error or a variation in the lengths of the sheets in a conveyance direction.

According to an aspect of the present invention, a sheet processing apparatus includes a sheet stacking unit where sheets to be processed are stacked, a regulating member configured to abut on one edge of sheets conveyed to the sheet stacking unit in a sheet conveyance direction to regulate position of a sheet in the sheet conveyance direction, a sheet waiting unit configured to keep sheets waiting, stack the waiting sheets displaced sequentially so that a lower sheet is positioned closer to the regulating member than an upper sheet in response to the sheets being conveyed to the sheet stacking unit, and then convey the sheets to the sheet stacking unit, a first moving unit configured to sequentially move the sheets conveyed to the sheet stacking unit starting from a lowermost sheet, to be abutted against the regulating member, a second moving unit disposed upstream of the first moving unit in a moving direction, and configured to move the sheets conveyed to the sheet stacking unit to the first moving unit, and a control unit configured to control a movement of a next sheet by the second moving unit so that a next sheet does not reach the first moving unit until the sheet moved by the first moving unit is abutted against the regulating member.

According to exemplary embodiments of the present invention, it is possible to ensure that a plurality of stacked sheets can be aligned by sequentially moving the sheets into contact with a regulating member, starting from a lower sheet, while preventing a next sheet from reaching the first moving unit until the sheet is abutted against the regulating member.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Figure 1:
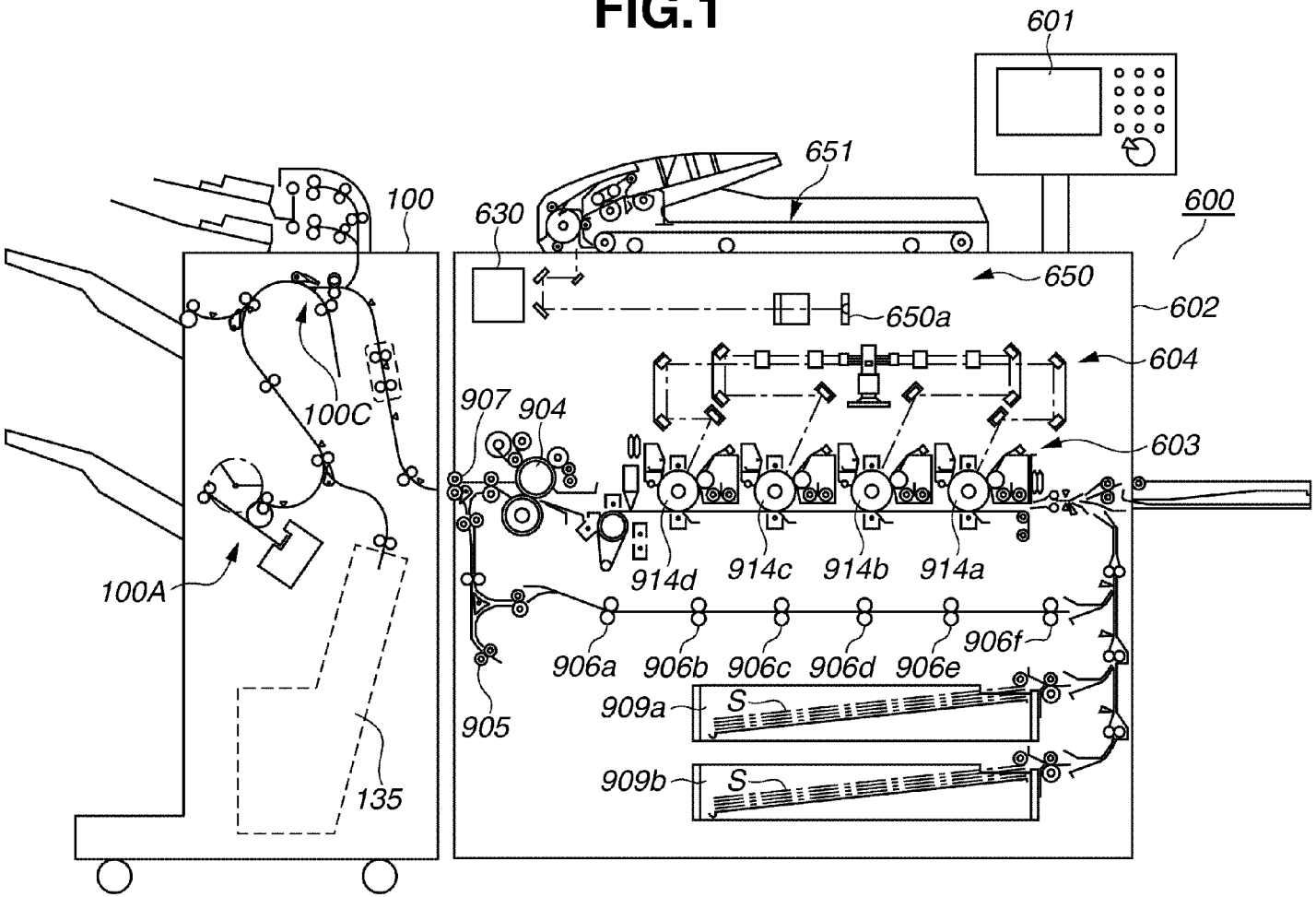
FIG. 1 illustrates the configuration of a monochrome/color copying machine that is an example of an image forming apparatus including a sheet processing apparatus according to a first exemplary embodiment.

Various exemplary embodiments, features, and aspects of the invention will be described in detail below with reference to the drawings. In an example, a sheet processing apparatus is configured to sequentially move sheets S1 and S2 conveyed to an intermediate processing tray, starting from the lowermost sheet S1, into contact with a trailing edge stopper by a drawing belt roller. The sheet processing apparatus drives a paddle, which is disposed upstream of the drawing belt roller in a moving direction to move the sheets S1 and S2 conveyed to the intermediate processing tray to convey them to the drawing belt roller, in such a manner that the next sheet S2 does not reach the drawing belt roller until the sheet S1 moved by the drawing belt roller is abutted against the trailing edge stopper.

Hereinafter, exemplary embodiments will be described in detail with reference to the drawings. FIG. 1 illustrates the configuration of a monochrome/color copying machine that is an example of an image forming apparatus including a sheet processing apparatus according to a first exemplary embodiment. FIG. 1 illustrates a monochrome/color copying machine 600, a monochrome/color copying machine main body (hereinafter referred to as "copying machine main body") 602, a document reading unit (image reader) 650 disposed at the upper portion of the copying machine main body 602, and a document conveyance apparatus 651 allowing a plurality of documents to be automatically read.

The copying machine main body 602 includes, for example, sheet feeding cassettes 909*a* and 909*b* each containing a stack of normal sheets S for forming an image, an image forming unit 603 configured to form a toner image on a sheet by using an electrophotographic process, and a fixing unit 904 configured to fix the toner image formed on the sheet. Further, an operation unit 601, which allows a user to provide various kinds of inputs and select various kinds of settings for the copying machine main body 602, is connected to the upper surface of the copying machine main body 602. Further, a finisher 100 which is a sheet processing apparatus, is connected to the side of the copying machine main body 602. A central processing unit (CPU) circuit unit 630 is a controller that controls the copying machine main body 602 and the finisher 100.

When this monochrome/color copying machine 600 forms an image of a document (not illustrated) on a sheet, first, an image of a document conveyed by the document conveyance apparatus 651 is read by an image sensor 650*a* disposed at the document reading unit 650. After that, the read digital data is input into an exposure apparatus 604, and the exposure apparatus 604 illuminates photosensitive drums 914 (914*a* to 914*d*) provided in the image forming unit 603 with light according to the read digital data. The illumination of the light forms electrostatic latent images on the surfaces of the photosensitive drums 914*a* to 914*d*, and development of these electrostatic latent images forms respective yellow, magenta, cyan, and black toner images on the surfaces of the photosensitive drums 914*a* to 914*d*.

Next, these toner images of four colors are transferred onto a sheet fed from the sheet feeding cassette 909*a* or 909*b*. After that, the toner images transferred on the sheet are permanently fixed by the fixing unit 904. After the toner images are fixed in this manner, the sheet is discharged from a discharge roller pair 907 to the finisher 100 connected to the side of the coping machine main body 602, if the copying machine 600 is in a mode for forming an image on one surface of the sheet.

Alternatively, if the copying machine 600 is in a mode for forming images on the both surfaces of the sheet, the sheet is transferred from the fixing unit 904 to reversing rollers 905. After that, the reversing rollers 905 are reversely rotated at predetermined timing to convey the sheet toward two-sided conveyance rollers 906*a* to 906*f*. Then, after that, the sheet is conveyed to the image forming unit 603 again, and toner images of four colors, yellow, magenta, cyan, and black are transferred onto the back surface of the sheet. The sheet with the toner images of the four colors formed on the back surface in this way is conveyed to the fixing unit 904 again, and the toner images are fixed there. After that, the sheet is discharged from the discharge roller pair 907, and is conveyed to the finisher 100.

The finisher 100 introduces sheets discharged from the copying machine main body 602 in order, and performs processing for aligning a plurality of introduced sheets to put together them into one bundle, and a punching processing for forming holes around the trailing edges of the introduced sheets. Further, the finisher 100 performs processing such as stapling processing (binding processing) for stapling the sheet bundle at the trailing edge side, and bookbinding processing. The finisher 100 includes a stapler unit 100A, which is a binding unit for stapling the sheets, and a saddle unit 135 for folding the sheet bundle in two to arrange the sheet bundle into the form of a book. Further, the finisher 100 includes a sheet waiting unit 100C. (See FIG. 2 and FIG. 7B) The sheet waiting unit 100C keeps a plurality of sheets waiting, and stacks the waiting sheets gradually shifting so that the lowermost sheet is positioned closest to a regulating member when the sheets are conveyed to a sheet stacking unit, as will be described below. Then, the sheet waiting unit 100C conveys the sheets to the sheet stacking unit.

Figure 2:
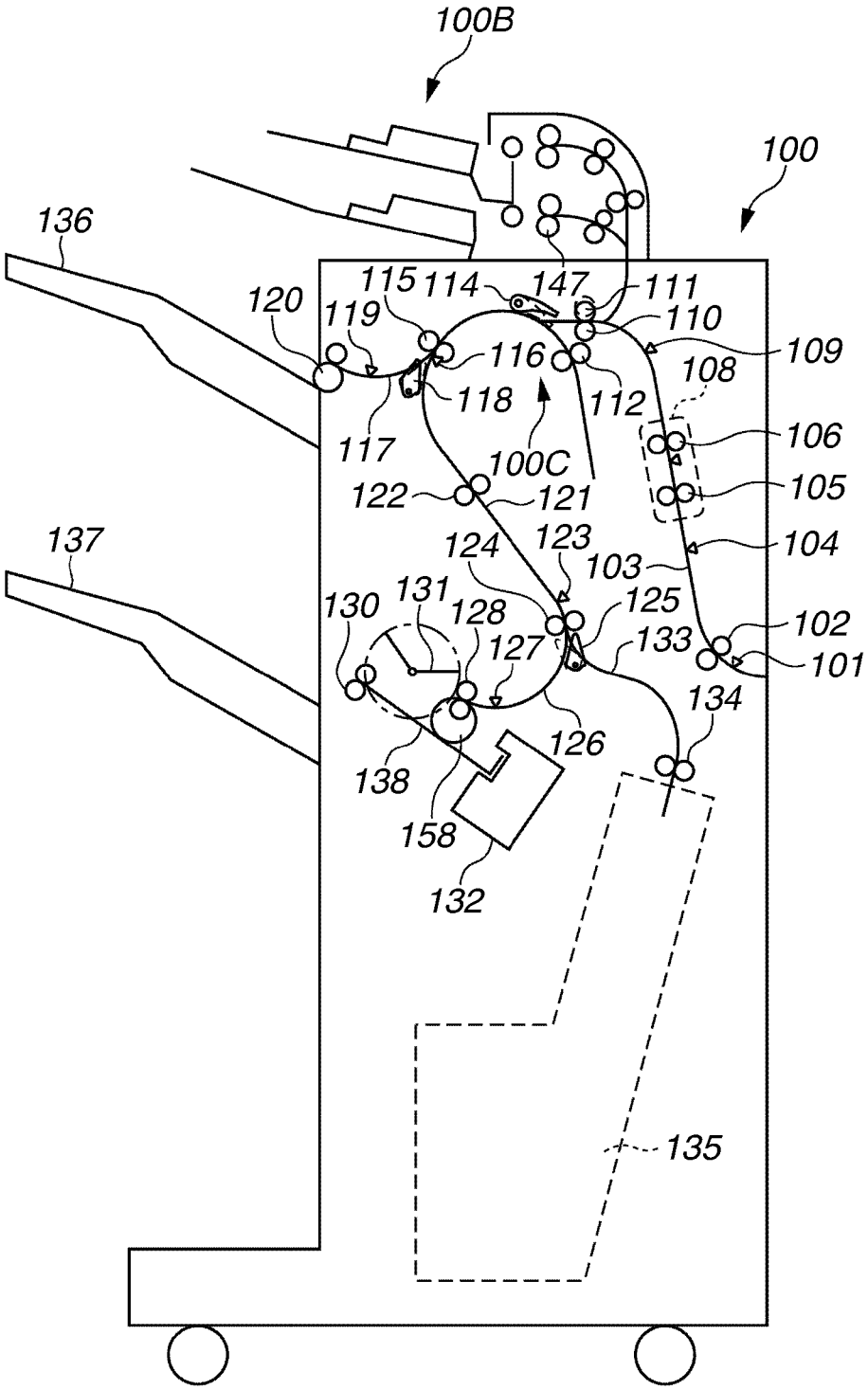
FIG. 2 illustrates the configuration of a finisher that is the above-described sheet processing apparatus.

As illustrated in FIG. 2, the finisher 100 includes an inlet roller pair 102 for introducing a sheet into the apparatus. The sheet discharged from the copying machine main body 602 is transferred to the inlet roller pair 102. At this time, the timing of the transfer of the sheet is also detected by an inlet sensor 101 simultaneously.

After that, while the sheet conveyed by the inlet roller pair 102 is transmitted through a conveyance path 103, the edge position of the sheet is detected by a lateral registration detection sensor 104, and how much the sheet is displaced in the width direction relative to the central position of the finisher 100 is detected. Further, after the displaced state in the width direction (hereinafter referred to as a "lateral registration error") is detected in this way, a shift unit 108 is moved by a predetermined amount in a frontward direction or a backward direction while the sheet is conveyed by shift roller pairs 105 and 106, whereby a sheet shift operation is performed. The term "frontward (front)" is herein used to refer to the front surface side of the apparatus when a user stands so as to face the operation unit 601 illustrated in FIG. 1, and the term "backward" is used to refer to the back surface side of the apparatus.

Next, the sheet is conveyed by a conveyance roller 110 and a separating roller 111, and reaches a first buffer roller pair 115. After that, in a case where the sheet is discharged to an upper tray 136, an upper path switching member 118 is set in a state indicated by the broken line in the drawing by a driving unit (not illustrated) such as a solenoid. As a result, the sheet is guided to an upper path conveyance path 117, and is discharged to the upper tray 136 by an upper discharge roller pair 120.

In a case where the sheet is not discharged to the upper tray 136, the sheet conveyed by the first buffer roller pair 115 is guided to a bundle conveyance path 121 by the upper path switching member 118 in a state illustrated by the solid line. After that, the sheet is transmitted through the bundle conveyance path 121 by a conveyance roller pair 122 and a bundle conveyance roller pair 124 in order. Further, a second buffer roller pair 112, a first buffer sensor 109, and a second buffer sensor 116 are provided in the finisher 100. In a case where the sheet is buffered as will be described below, the first buffer roller pair 115 and the second buffer roller pair 112 are driven based on the detection by the first and second buffer sensors 109 and 116.

Next, in a case where the conveyed sheet is discharged to a stacking tray 137 disposed at the lower side, the sheet is conveyed to a lower path 126 by a saddle path switching member 125 in a state indicated by the solid line. After that, the sheet is sequentially conveyed to an intermediate processing tray 138 which is a sheet stacking unit where sheets to be processed are stacked, by a lower discharge roller pair 128 which is a sheet conveyance unit.

Figure 3:
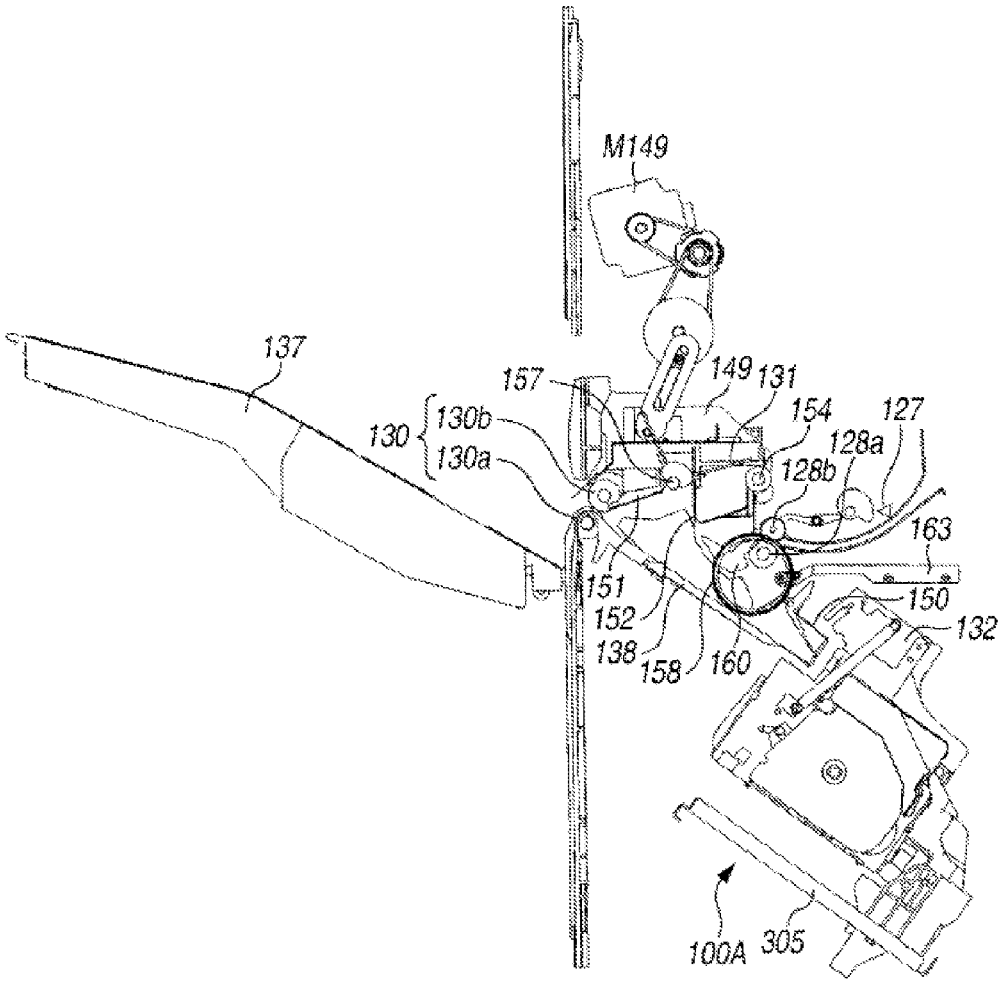
FIG. 3 illustrates the configuration of a stapler unit provided to the finisher.

As illustrated in FIG. 3, the intermediate processing tray 138 is located below the lower discharge roller pair 128 (128*a* and 128*b*), and is inclined with the downstream side (the left side in FIG. 3) in a sheet bundle discharging direction at the upper side, and the upstream side (the right side in FIG. 3) at the lower side. A trailing edge stopper 150 is a regulating member configured to abut on one edge of sheet conveyed to the intermediate processing tray 138 in the conveyance direction to regulate the positions of the sheets in the conveyance direction. The trailing edge stopper 150 is disposed at the lower end of the intermediate processing tray 138 at the upstream side. Further, a bundle discharge roller pair 130 (130*a* and 130*b*) is disposed at the end of the intermediate processing tray 138 at the downstream side.

The bundle discharge roller pair 130 is configured to rotate in a normal direction and a reverse direction by a bundle discharge motor M130 illustrated in FIG. 6, which will be described below. Further, the upper bundle discharge roller 130*b* is disposed at the front end of the bottom surface of a swing guide 149, and is configured to contact and separate from the lower bundle discharge roller 130*a* according an opening/closing operation of the swing guide 149. This swing guide 149 is supported by a support shaft 154, and is rotatable around the support shaft 154 to vertically open or close by a swing guide motor M149. Further, an intermediate processing front sensor 127 is disposed upstream of the lower discharge roller pair 128*a* and 128*b* in the conveyance direction, such that sheet transfer timing onto the lower discharge roller pair 128 is detected based on the detection of the intermediate processing front sensor 127.

Further, a trailing edge drop member 160, which drops a plurality of buffered sheets onto the intermediate processing tray 138 by hitting them from above, as will be described below, is disposed at a position near the downstream side of the lower discharge roller pair 128 in the conveyance direction. A trailing edge drop member driving motor M160 is driven at appropriate timing based on a signal from a trailing edge drop member HP sensor 162. The trailing edge drop member HP sensor 162 detects a home position of the trailing edge drop member 160 as illustrated in FIG. 6 that will be described below. The trailing edge drop member 160 is dropped by the driving of the trailing edge drop member driving motor M160. Then, it is possible to bring a sheet into contact with a drawing belt roller 158, which will be described below, in a short time by dropping the trailing edge drop member 160 in this manner.

A stapler 132, which is a binding unit, is fixed on a slide support plate 305, and is configured to move along the trailing edges of sheets stacked on the intermediate processing tray 138. A plurality of drawing paddles 131 is disposed above the intermediate processing tray 138, and along a driving shaft 157 disposed downstream of the lower discharge roller pair 128 in the discharge direction. A drawing paddle driving motor M131 is driven at appropriate timing based on a signal from a drawing paddle HP sensor 161 illustrated in FIG. 6, which will be described below. The driving shaft 157 is rotated by the driving of the drawing paddle driving motor M131, and the drawing paddles 131, which are a second moving unit, are rotated by the rotation of the driving shaft 157.

A drawing belt roller 158, which draws sheets stacked on the intermediate processing tray 138 to move them to the trailing edge stopper 150, is hung around the outer circumference of the lower discharge roller 128*a*. This drawing belt roller 158 rotates driven by a rotation of the lower discharge roller 128*a*. A pulling member driving motor M180 is driven based on a signal from a pulling member position sensor 181 illustrated in FIG. 6, which will be described below. A pulling member 163 moves driven by the pulling member driving motor M180, and the drawing belt roller 158, which is a first moving unit, is pulled by the pulling member 163. Then, the drawing belt roller 158 is pulled by the pulling member 163 to move to a contact position, in which the lower portion of the drawing belt roller 158 contacts an uppermost sheet among sheets stacked on the intermediate processing tray 138, and a retracting position, in which the drawing belt roller 158 does not interfere with sheets released onto the intermediate processing tray 138.

In this way, the sheets conveyed to the intermediate processing tray 138 are sequentially moved to the trailing edge stopper 150 by the drawing paddles 131 and the drawing belt roller 158, and alignment processing is performed on a predetermined number of sheets on the intermediate processing tray 138. Next, binding processing is performed on the sheet bundle thus-aligned on the intermediate processing tray 138 by the stapler 132, which serves as the binding unit as necessary. After that, the sheet bundle is discharged onto the lower stacking tray 137 by the bundle discharge roller pair 130. This stapler 132 is movable in the width direction (hereinafter referred to as "front-back direction") perpendicular to the sheet conveyance direction, and can bind a plurality of portions at the trailing edge of the sheet bundle on the intermediate processing tray 138 (on the sheet stacking unit).

On the other hand, in a case where saddle-stitching processing (saddle stitch binding) is performed on sheets, the saddle path switching member 125 is moved to the position indicated by the broken line as illustrated in FIG. 2, by the driving unit (not illustrated) such as a solenoid. As a result, the sheets are conveyed to a saddle path 133, are guided to a saddle unit 135 by a saddle inlet roller pair 134, and are saddle-stitched (saddle stitch binding processing). Referring to FIG. 2, an inserter 100B is disposed above the finisher 100. This inserter 100B serves to insert a sheet (insert sheet) different from normal sheets at a first page or a last page in a sheet bundle, or between sheets with images formed by the copying machine main body 602.

Figure 4:
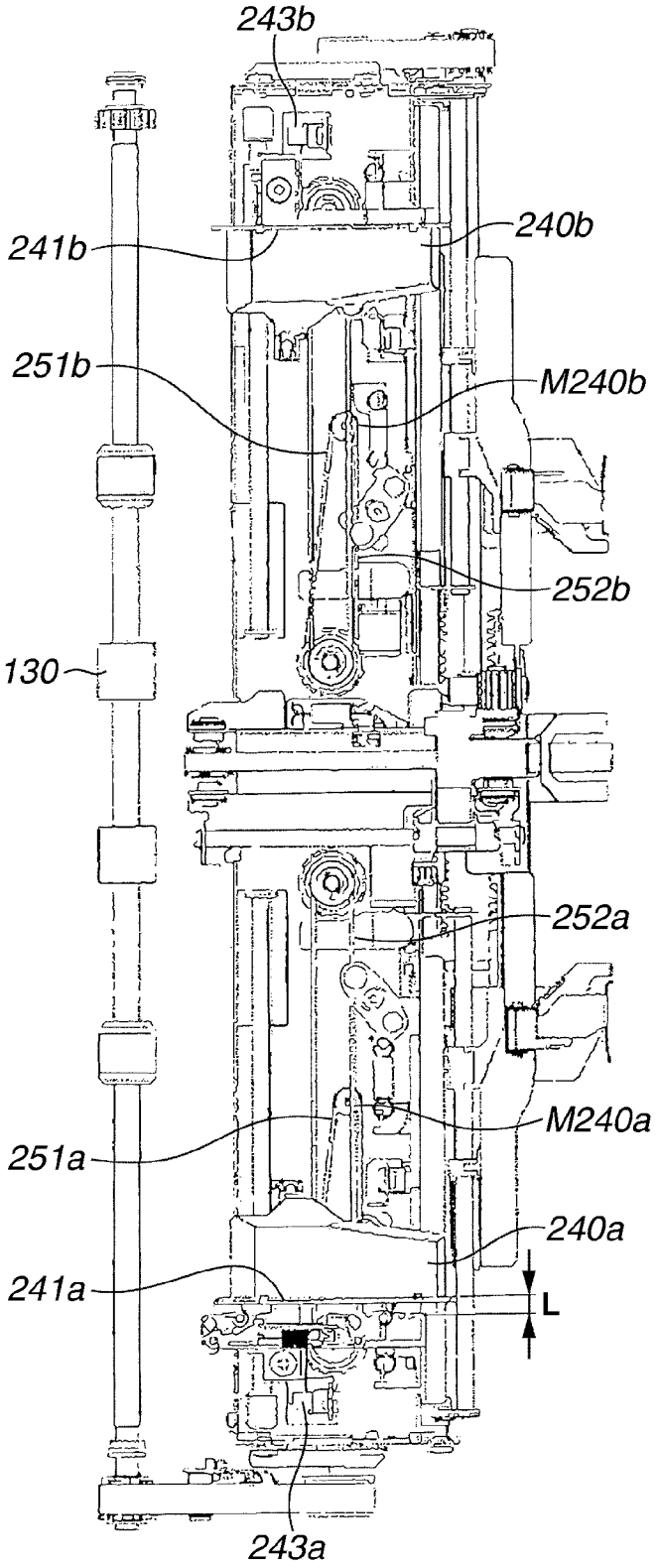
FIG. 4 illustrates the configuration of an intermediate processing tray provided to the finisher.

Alignment members 240*a* and 240*b*, which constitute a width direction alignment unit for aligning positions of sheets in the width direction as illustrated in FIG. 4, are disposed on the intermediate processing tray 138. These alignment members 240*a* and 240*b* are disposed at the front side and the back side on the intermediate processing tray 138 in such a manner that alignment surfaces 241*a* and 241*b* face each other. The alignment members 240*a* and 240*b* serve to align the edges of contained sheets in the width direction. The alignment members 240*a* and 240*b* include alignment member motors M240*a* and M240*b*, which are independently drivable. The alignment members 240*a* and 240*b* are configured to move relative to the intermediate processing tray 138 along the sheet width direction from tip pulleys of the alignment member motors M240*a* and M240*b* via first transmission belts 251*a* and 251*b* and second transmission belts 252*a* and 252*b*. Further, alignment member HP sensors 243*a* and 243*b*, which detect the home positions of the alignment members 240*a* and 240*b*, are disposed at such positions on the intermediate processing tray 138 that the alignment members 240*a* and 240*b* are located farthest away from each other.

Figure 5:
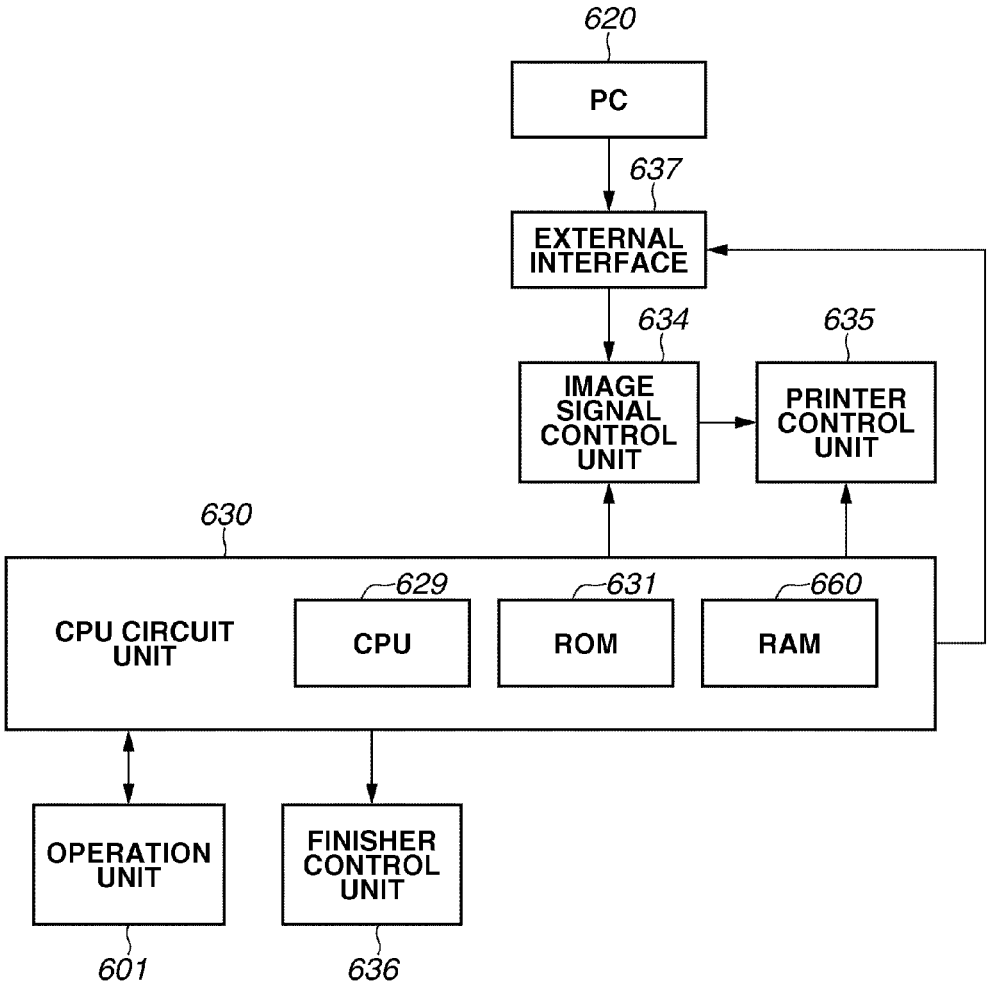
FIG. 5 is a control block diagram of the above-described monochrome/color copying machine.

FIG. 5 is a control block diagram of the monochrome/color copying machine 600. The CPU circuit unit 630 includes a CPU 629, a read only memory (ROM) 631 storing, for example, a control program, and a random access memory (RAM) 660 used as an area for temporarily holding control data and a working area for a calculation to be performed in control processing. Further, in FIG. 5, an external interface 637 is an interface between the monochrome/color copying machine 600 and an external personal computer (PC) 620. Upon reception of print data from the external PC 620, the external interface 637 develops this data into a bitmap image, and outputs the bitmap image to an image signal control unit 634 as image data.

Then, the image signal control unit 634 outputs this data to a printer control unit 635. The printer control unit 635 outputs the data from the image signal control unit 634 to an exposure control unit (not illustrated). Further, the operation unit 601 includes, for example, a plurality of keys for allowing a user to set various kinds of functions relating to image formation, and a display unit for displaying the setting statuses. Then, the operation unit 601 outputs a key signal corresponding to a user's operation of each key to the CPU circuit unit 630, and displays corresponding information based on a signal from the CPU circuit unit 630 on the display unit.

The CPU circuit unit 630 controls the image signal control unit 634 according to the control program stored in the ROM 631 and the settings of the operation unit 601, and controls the image forming unit 603 (refer to FIG. 1) via the printer control unit 635. Further, the CPU circuit unit 630 controls the finisher 100 via a finisher control unit 636.

In the present exemplary embodiment, the finisher control unit 636 as a control unit is mounted on the finisher 100, and controls driving of the finisher 100 by exchanging information with the CPU circuit unit 630. Alternatively, the finisher control unit 636 maybe disposed on the copying machine main body integrally with the CPU circuit unit 630 to control the finisher 100 directly from the copying machine main body.

Figure 6:
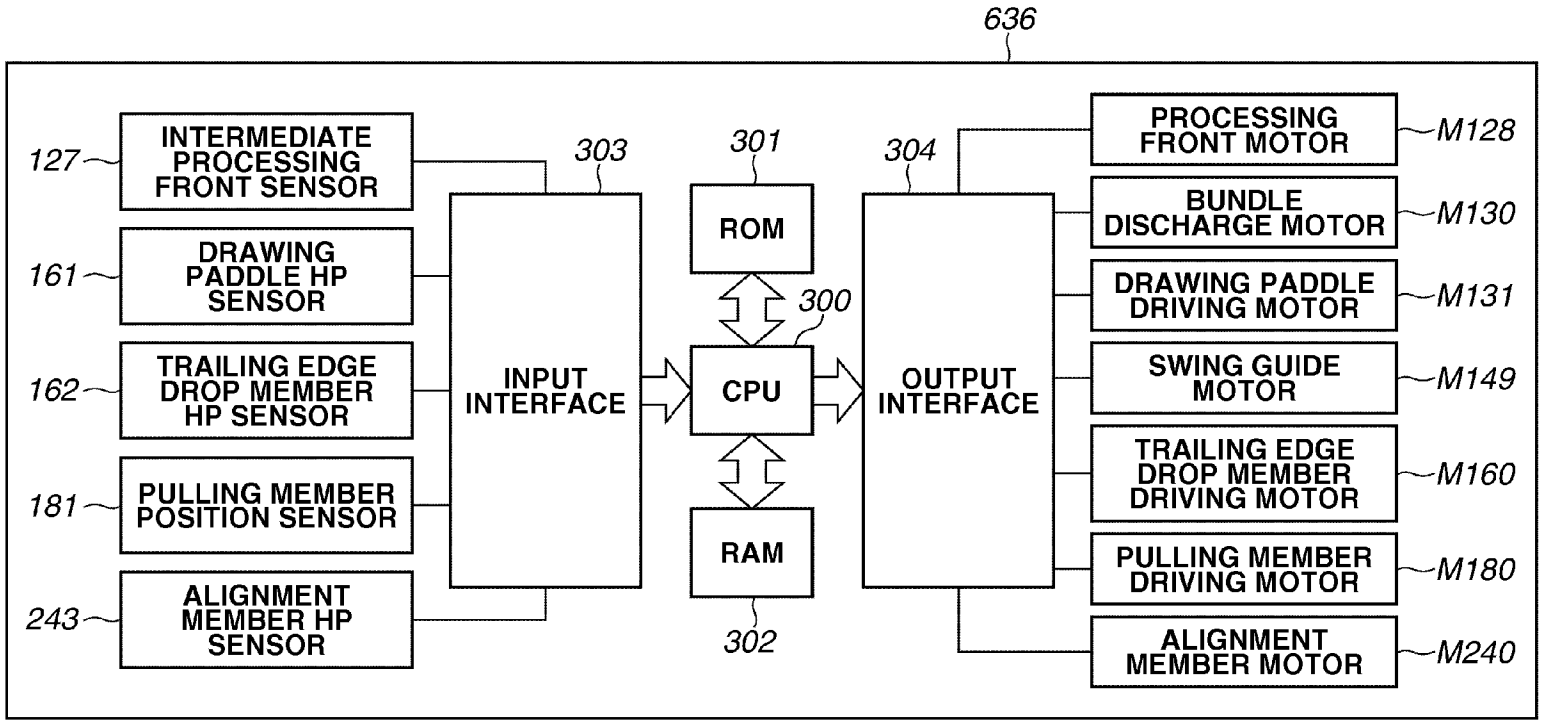
FIG. 6 is a control block diagram of the above-described finisher.

FIG. 6 is a control block diagram of the finisher 100 according to the present exemplary embodiment. The finisher control unit 636 as the controller is constituted by a microcomputer system, and includes, for example, a CPU 300, a ROM 301, and a RAM 302. A program for puncher processing and a program for stapling processing are stored in the ROM 301 in advance. The CPU 300 executes the respective programs and performs input data processing while exchanging data with the RAM 302 as necessary, thereby generating a predetermined control signal. Further, data reception and transmission are performed between the CPU 300 and the CPU circuit unit 630, which is mounted at the copying machine main body, and the CPU 300 acquires various kinds of information such as the size of a document and a copy quantity from the CPU circuit unit 630 at the main body side.

Further, the intermediate processing front sensor 127, the drawing paddle HP sensor 161, the trailing edge drop member HP sensor 162, the pulling member position sensor 181, and the alignment member HP sensors 243 are connected to an input interface 303. Detection signals acquired from these detection units are input into the CPU 300 via the input interface 303 as input data.

Further, a processing front motor M128 for driving the lower discharge roller pair 128, the bundle discharge motor M130 for driving the bundle discharge roller pair 130, the drawing paddle driving motor M131 for the drawing paddles 131 are connected to an output interface 304. Further, the swing guide motor M149 for driving the swing guide 149, the trailing edge drop member driving motor M160 for the trailing edge drop member 160, the pulling member driving motor M180 for the pulling member 180, and the alignment member motors M240 are connected to the output interface 304. Then, the CPU 300 outputs various kinds of control signals to the respective motors via the output interface 304 based on the input data.

In the present exemplary embodiment, in a case where the finisher 100 performs binding processing, during execution of the binding processing on a sheet bundle on the intermediate processing tray 138, the finisher 100 keeps first several sheets in a sheet bundle to be processed next, waiting in a stacked state to secure a time required to perform the binding processing on the sheets. Then, when the finisher 100 processes the next sheet bundle after completing the binding processing of the sheet bundle on the intermediate processing tray 138, the finisher 100 first conveys the waiting several sheets to the intermediate processing tray 138, in the stacked state.

Further, in the present exemplary embodiment, after the finisher 100 conveys the first several sheets in the stacked state, the finisher 100 keeps the next several sheets waiting in a stacked state to secure a time required for alignment processing in the width direction. The alignment processing is performed each time sheets are discharged onto the intermediate processing tray 138. Hereinafter, the term "initial buffering processing" is used to refer to processing for keeping first several sheets in a sheet bundle to be processed next and waiting in a stacked sheet, and the term "middle buffering processing" is used to refer to processing for keeping the next several sheets waiting in a stacked state.

Further, the term "initial buffered sheets" is used to refer to sheets stacked by the initial buffering processing, and the term "middle buffered sheets" is used to refer to sheets stacked by the middle buffering processing. Generally, a time taken for binding processing is longer than a time taken for width alignment processing, so that the number of stacked initial buffered sheets is larger than the number of stacked middle buffered sheets. Therefore, in the present exemplary embodiment, the processing operation on the intermediate processing tray 138 is different between the initial buffering processing and the middle buffering processing.

Figure 7A:
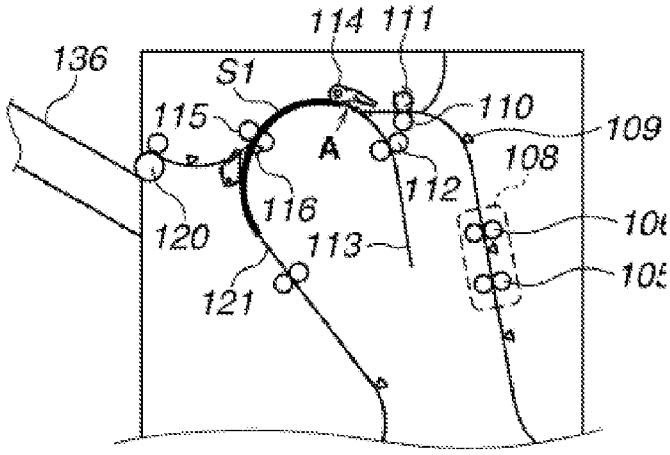
FIGS. 7A, 7B, and 7C illustrate an operation for stacking sheets in initial buffering processing and middle buffering processing by the above-described finisher.
Figure 7B:
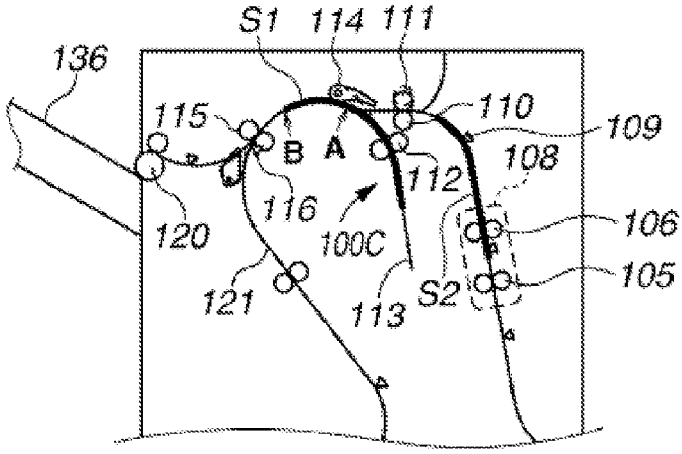
Figure 7C:
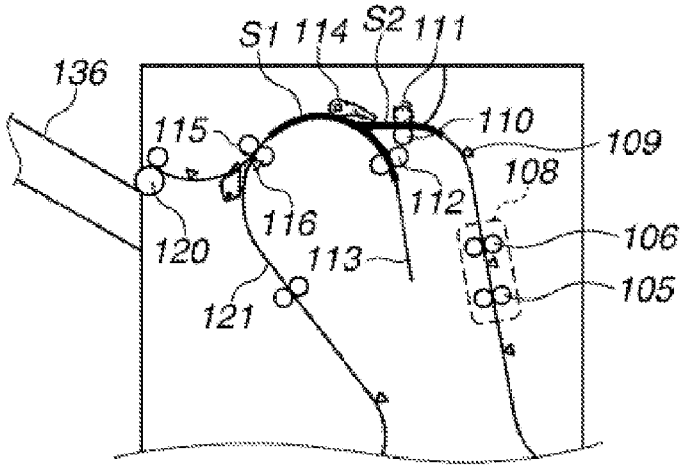

Next, an operation for stacking sheets in the initial buffering processing and the middle buffering processing according to the present exemplary embodiment will be described with reference to FIGS. 7A to 7C. As illustrated in FIG. 7A, a sheet S1 conveyed by the conveyance roller 110 and the separation roller 111 serving as a sheet conveyance unit is conveyed to the bundle conveyance path 121 extending between the conveyance roller 110 and the separation roller 111, and the intermediate processing tray 138. After that, the sheet S1 is conveyed by the first buffer roller pair 115, which is disposed at the bundle conveyance path 121 and can rotate in both the normal direction and the reverse direction.

Next, the second buffer sensor 116 detects the position of the leading edge of the sheet S1. The sheet S1 is conveyed based on this detected timing and sheet size information registered in advance until the position of the trailing edge of the sheet S1 reaches a branching point A of a buffer path 113. The branching point A branches from the bundle conveyance path 121 and is a waiting portion where a plurality of sheets to be processed next is kept waiting. At this time, a buffer path switching member 114 is switched into a state indicated by the broken line, by a driving unit (not illustrated).

Next, after the trailing edge of the sheet S1 reaches the branching point A in this way, the first buffer roller pair 115 is rotated in the reverse direction. Then, as illustrated in FIG. 7B, the trailing edge of the sheet S1 is guided to the buffer path 113, and the sheet S1 is transferred to the second buffer roller pair 112 rotating in the normal direction. The second buffer roller pair 112 can rotate in both the normal direction and the reverse direction. As a result, the sheet S1 is pulled in by the second buffer roller pair 112 until the leading edge of the sheet S1 reaches a position B, and is kept waiting there temporarily.

In the present exemplary embodiment, the sheet waiting unit 100C (FIG. 7B), where a plurality of sheets to be processed next is kept waiting during processing of a sheet bundle on the intermediate processing tray 138, includes the buffer path 113, the first buffer roller pair 115, and the second buffer roller pair 112.

Then, the finisher 100 waits for detection of a sheet S2 conveyed next by the first buffer sensor 109. The first buffer sensor 109 is disposed upstream of the branching point A, which separates the bundle conveyance path 121 and the buffer path 113, in the sheet conveyance direction. When the first buffer sensor 109 detects the sheet S2 conveyed next, the second buffer roller pair 112 is driven to rotate in the reverse direction to restart the conveyance of the sheet S1 kept temporarily waiting in synchronization with the conveyance of the sheet S2 so that the sheet S1 and the sheet S2 overlap with each other. As a result, the sheet S1 is returned to the conveyance path, and as illustrated in FIG. 7C, the sheet S1 and the sheet S2 are overlapping in such a manner that the upstream edges of the sheets S1 and S2 in the conveyance direction are displaced by a predetermined amount.

Figure 8A:
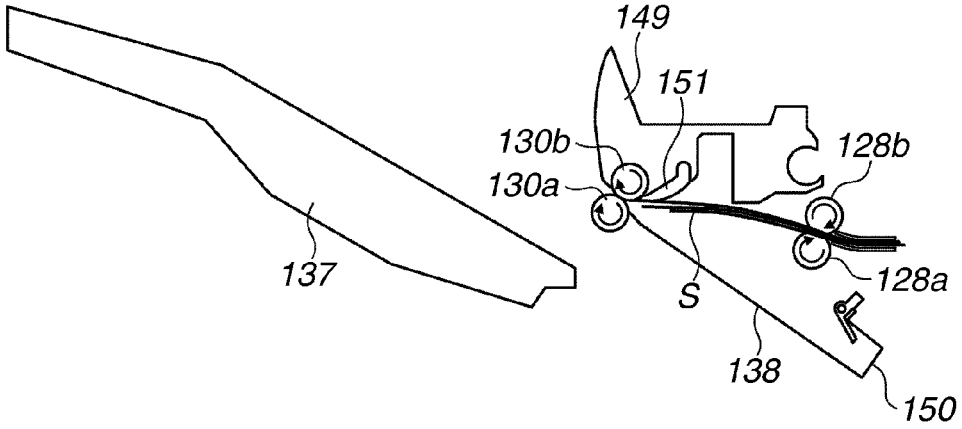
FIGS. 8A, 8B, and 8C are first diagrams illustrating an operation for aligning a sheet bundle stacked by the initial buffering processing.

Next, an alignment operation performed on the sheet bundle stacked by the initial buffering processing on the intermediate processing tray 138 will be described with reference to FIGS. 8A to 8C and 9A to 9C. First, as illustrated in FIG. 8A, first buffered sheets S, which include first several sheets (n sheets) in a sheet bundle to be processed next in a stacked state, are guided to a nip portion of the bundle discharge roller pair 130 by the lower discharge roller pair 128 (128*a* and 128*b*) along a guide 151. At this time, the swing guide 149 is closed, and therefore the rollers 130*a* and 130*b* of the bundle discharge roller pair 130 are in contact with each other. Further, the bundle discharge roller pair 130 is rotating in the direction for discharging the buffered sheets S to the stacking tray 137.

Figure 8B:
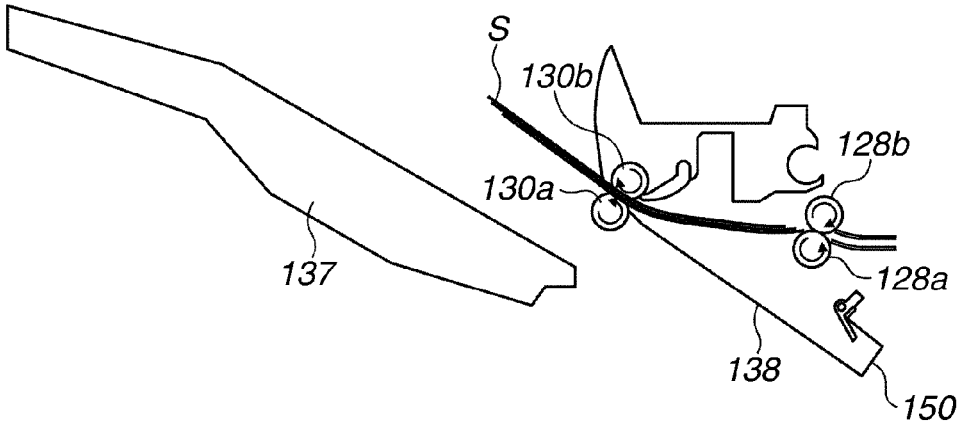
Figure 8C:
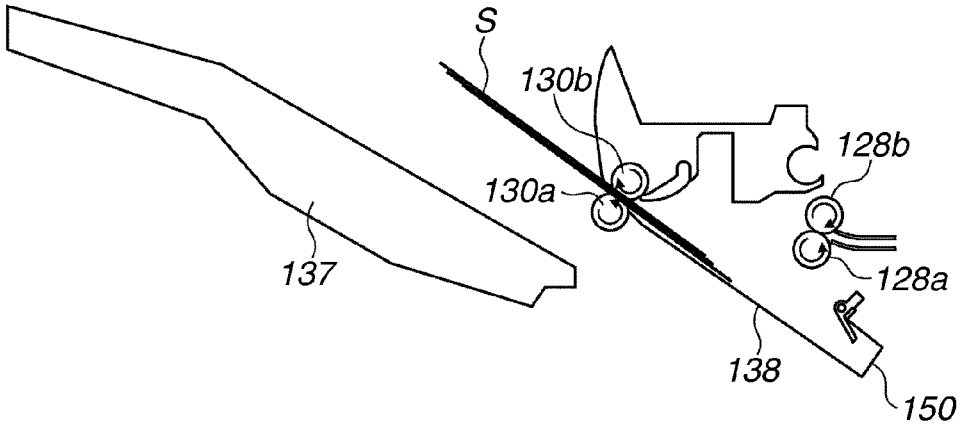
Figure 9A:
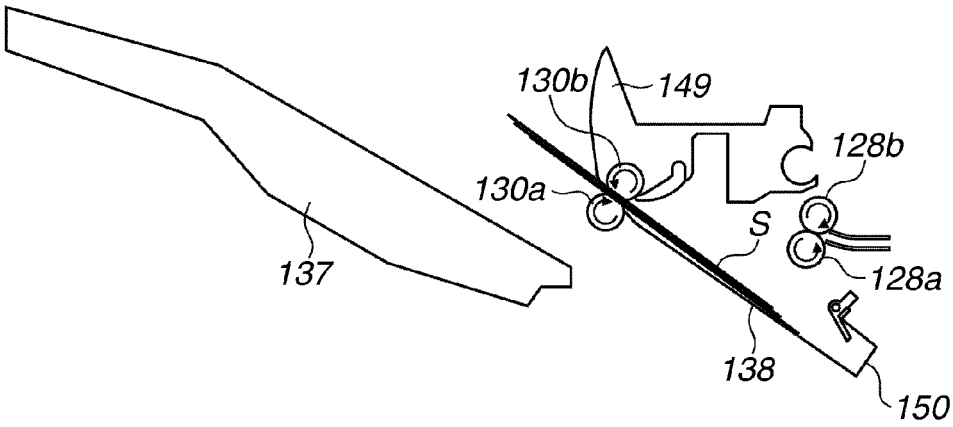
FIGS. 9A, 9B, and 9C are second diagrams illustrating the operation for aligning the sheet bundle stacked by the above-described initial buffering processing.

As a result, the buffered sheets S transferred to the bundle discharge roller pair 130 are conveyed as it is in the discharging direction to the stacking tray 137, by the bundle discharge roller pair 130 until the trailing edges of the buffered sheets S exit the lower discharge roller pair 128, as illustrated in FIG. 8B. After that, as illustrated in FIG. 8C, when the trailing edges of the buffered sheets S exit the lower discharge roller pair 128 to be placed on the intermediate processing tray 138, the bundle discharge roller pair 130 is rotated in the reverse direction. As a result, as illustrated in FIG. 9A, the buffered sheets S are moved in the direction abutting on the trailing edge stopper 150 disposed downstream of the intermediate processing tray 138 in the release direction.

Figure 9B:
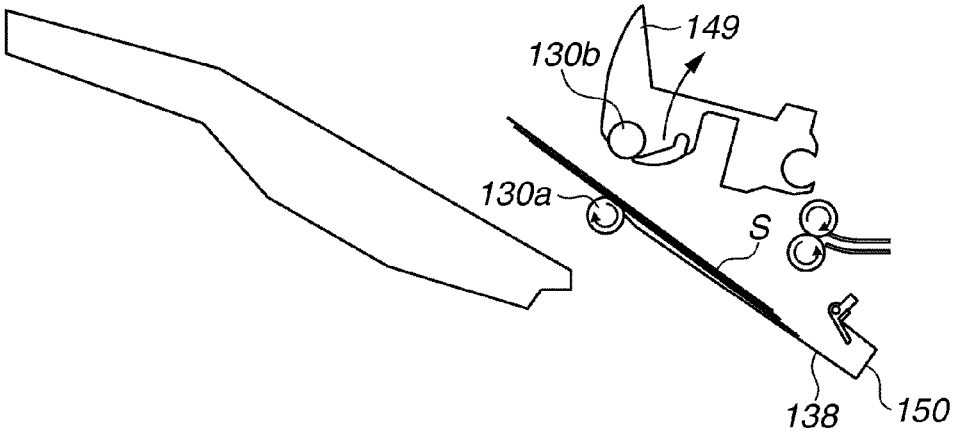
Figure 9C:
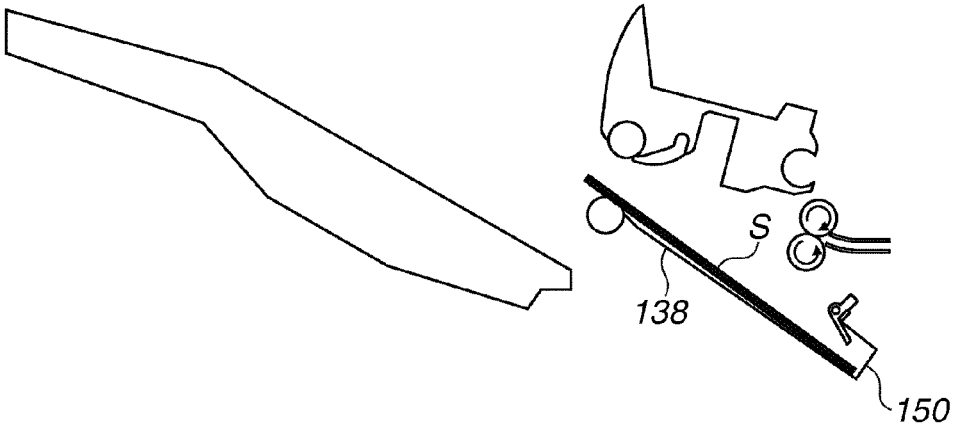

Next, as illustrated in FIG. 9B, before the buffered sheets S abut on the trailing edge stopper 150, the swing guide 149 is opened so that the bundle discharge rollers 130*a* and 130*b* are separated from each other, whereby the buffered sheets S are moved toward the trailing edge stopper 150. After that, as illustrated in FIG. 9C, the buffered sheets S abut on the trailing edge stopper 150, whereby the upstream edges of the sheets S in the conveyance direction, i.e., the downstream edges of the sheets in the moving direction are aligned. Then, after completion of this alignment in the conveyance direction, the alignment members 240 illustrated in FIG. 4 are moved in the width direction perpendicular to the discharge direction and in the direction moving the alignment members 240 toward each other, to abut on the buffered sheets S, thereby aligning the buffered sheets S in the width direction.

Figure 10A:
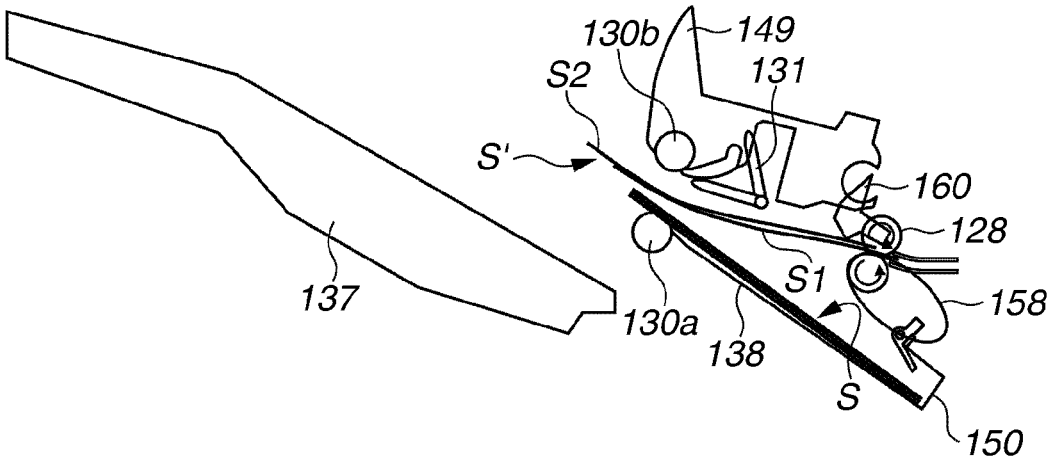
FIGS. 10A, 10B, and 10C are first diagrams illustrating an operation for aligning a sheet bundle stacked by the above-described middle buffering processing.

Next, an operation for aligning the sheet bundle stacked by the middle buffering processing will be described with reference to FIGS. 10A to 10C, and 11A and 11B. First, when the middle buffered sheets S' (the sheet S1 and the sheet S2) are conveyed, at least the initial buffered sheets S are already discharged onto the intermediate processing tray 138. Therefore, as illustrated in FIG. 10A, the finisher 100 is in such a state that the initial buffered sheets S are stacked on the intermediate processing tray 138, and the swing guide 149 is rotated upwardly so that the bundle discharge rollers 130*a* and 130*b* are separated from each other. Further, the drawing paddles 131 and the drawing belt roller 158 are located at their retracting positions where the drawing paddles 131 and the drawing belt roller 158 are not in contact with sheets being conveyed. Then, a series of processing is performed on the middle buffered sheets S', while this state is maintained.

More specifically, the conveyance of the buffered sheets S' is started in such a state that the drawing paddles 131 and the drawing belt roller 158 are located at the retracting positions where the drawing paddles 131 and the drawing belt roller 158 are not in contact with the sheets S'. It should be noted that the middle buffered sheets S' are conveyed while the conveyed middle buffered sheets S' are stacked being displaced in the conveyance direction in such a manner that the lower sheet S1 of the vertically stacked sheets is more displaced toward the trailing edge stopper 150 than the upper sheet S2. In other words, when the buffered sheets S' are conveyed to the intermediate processing tray 138, the buffered sheets S' are conveyed by the sheet waiting unit 100C in such a state that the buffered sheets S' are stacked with the trailing edges thereof sequentially displaced so that the lowermost sheet is located closest to the trailing edge stopper 150.

Figure 10B:
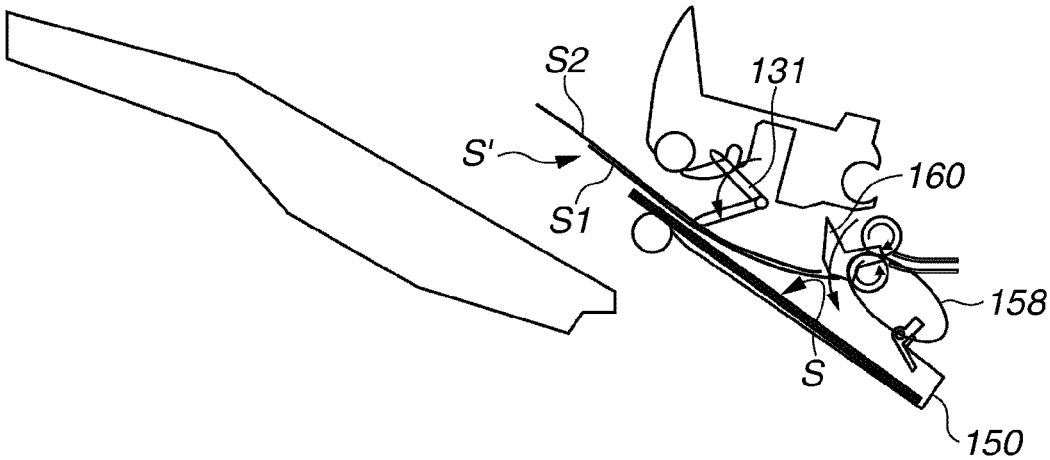

Then, the conveyance of the middle buffered sheets S' is started, and the trailing edges of the middle buffered sheets S', i.e., the trailing edge of the lower sheet 51 exits the lower discharge roller pair 128. Immediately after that, as illustrated in FIG. 10B, the trailing edge drop member 160 is rotated downwardly to hit the trailing edge of the lower sheet 51 from above, thereby dropping the buffered sheets S' toward the intermediate processing tray 138. Approximately at the same time, the drawing paddles 131 start to rotate to hold the buffered sheets S' from above. As a result, it is possible to prevent the upper sheet S2 from being ejected toward the staking tray 137.

Figure 10C:
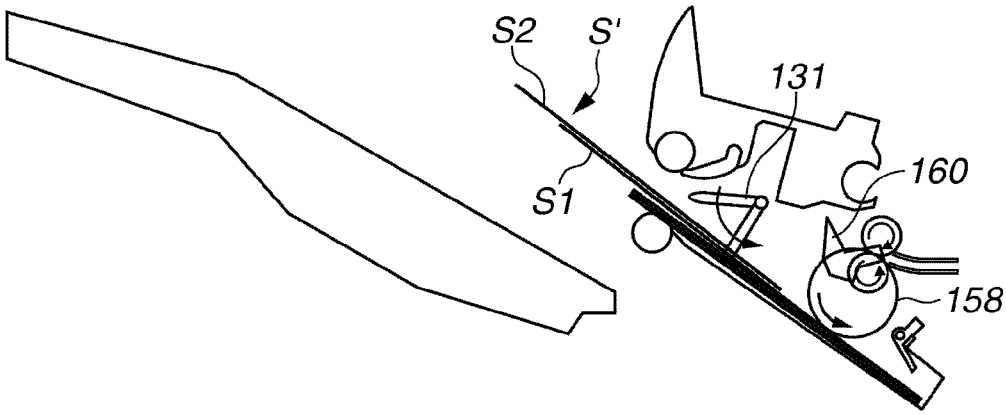

Then, after the drawing paddles 131 hold the buffered sheets S' in this way, the drawing paddles 131 are subsequently rotated, thereby starting to move the upper sheet S2 in the direction toward the drawing belt roller 158. Further, when the middle buffered sheets S' are dropped onto the intermediate processing tray 138, the pulling member 163 illustrated in FIG. 3 is moved toward the lower discharge roller pair 128, whereby the drawing belt roller 158 is lowered to the contact position where the drawing belt roller 158 contacts the lower sheet 51, as illustrated in FIG. 10C. Then, after that, the lower discharge roller 128*a* is rotated to cause a rotation of the drawing belt roller 158 to start a movement of the lower sheet (the lowermost sheet) S1 in the direction toward the trailing edge stopper 150.

At this time, the force of the drawing belt roller 158 for moving the lower sheet S1 is set to be larger than frictional resistance forces of the sheets above and below the lower sheet S1, i.e., frictional resistance forces applied from the upper sheet S2 and the uppermost sheet of the initial buffered sheets S. As a result, it is possible to move the lower sheet S1 by the rotation of the drawing belt roller 158.

Further, the frictional force between the drawing paddles 131 and the upper sheet S2 is larger than the force applied to the upper sheet S2 for moving the upper sheet S2, owing to the fictional force between the upper sheet S2 and the lower sheet S1 moved by the drawing belt roller 158. Therefore, the upper sheet S2 is drawn and moved at a moving speed (drawing speed) Vp of the drawing paddles 131 until the upper sheet S2 reaches the drawing belt roller 158, while the lower sheet S1 is drawn and moved at a moving speed (drawing speed) Vb of the drawing belt roller 158.

Figure 11A:
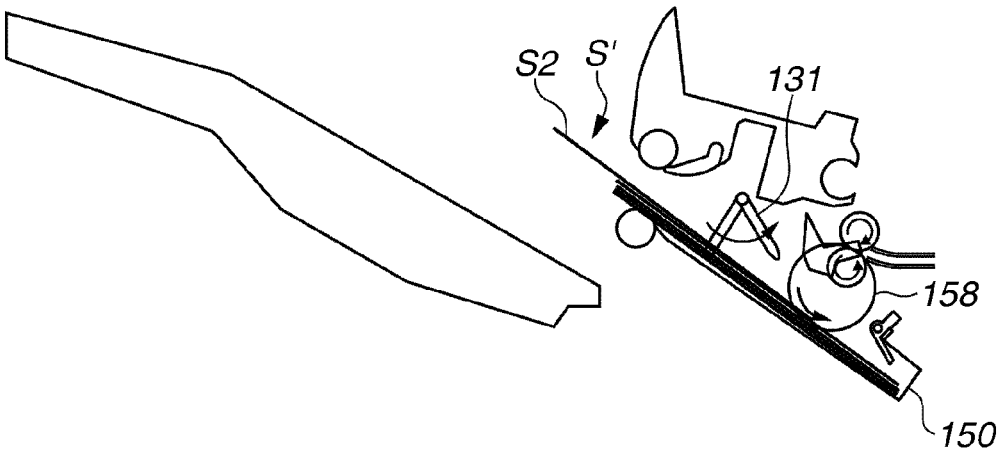
FIGS. 11A and 11B are second diagrams illustrating the operation for aligning the sheet bundle stacked by the above-described middle buffering processing.

After that, the lower sheet S1 is moved by the drawing belt roller 158 until the lower sheet S1 abuts on the trailing edge stopper 150 to be aligned in the conveyance direction. Further, as illustrated in FIG. 11A, the upper sheet S2 is transferred to the drawing belt roller 158 by the drawing paddle 131 when the lower sheet S1 abuts on the trailing edge stopper 150.

Figure 11B:
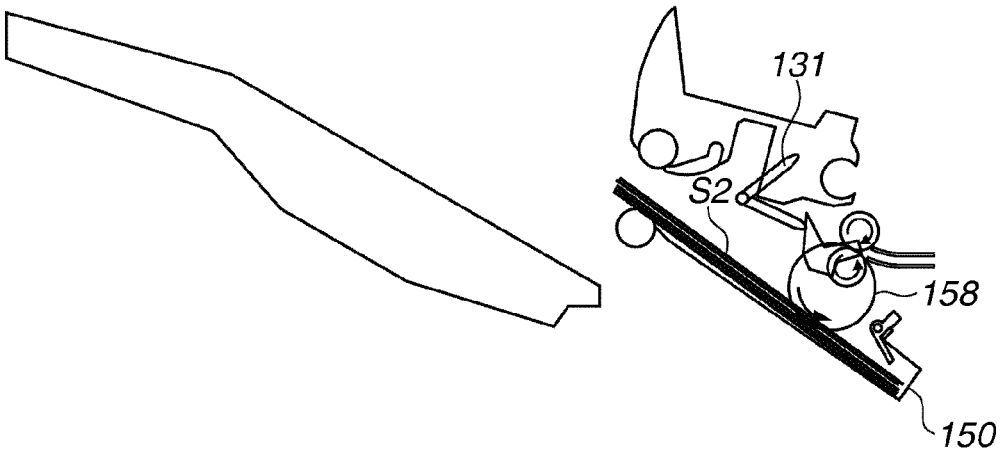

After that, the upper sheet S2 transferred to the drawing belt roller 158 is subsequently moved by the drawing belt roller 158 until the upper sheet S2 abuts on the trailing edge stopper 150 to be aligned in the conveyance direction as illustrated in FIG. 11B. In this way, the processing for aligning the middle buffered sheets in the conveyance direction is completed. After the completion of the alignment in the conveyance direction in this way, the alignment members 240 are moved to align the sheets in the sheet width direction.

Figure 12:
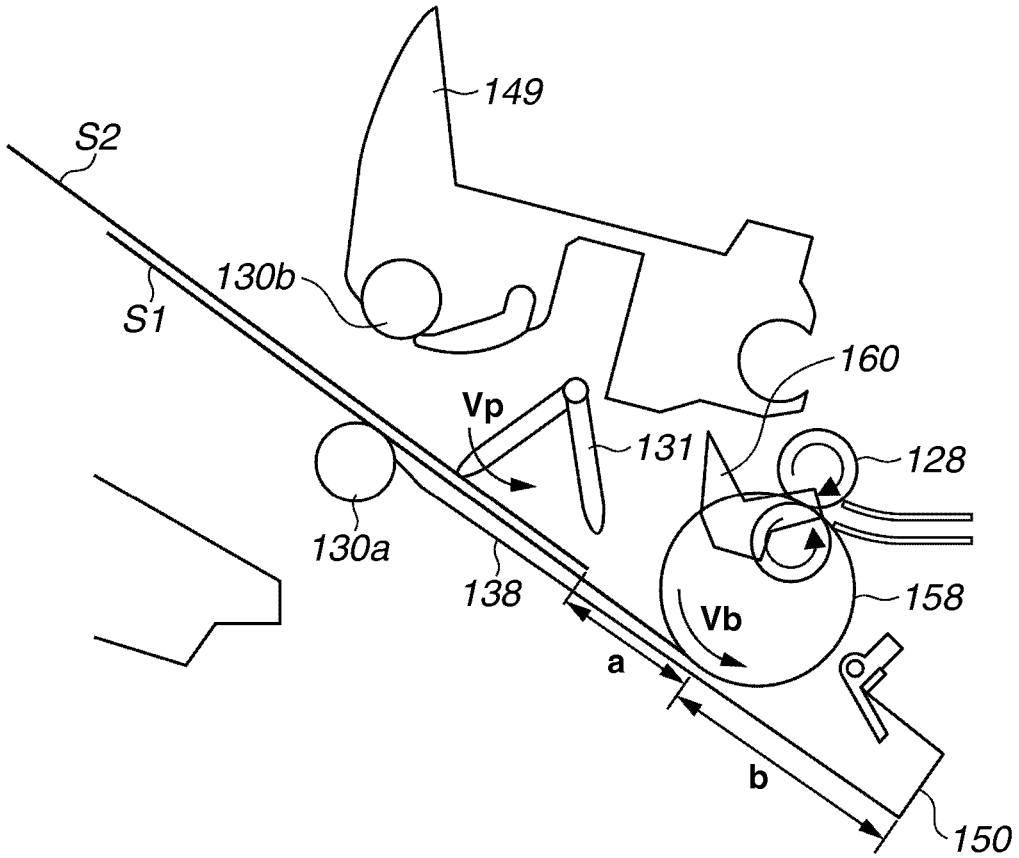
FIG. 12 illustrates the relationship between sheet moving speeds of drawing paddles and a drawing belt roller provided to the above-described finisher.

Next, the relationship between the sheet moving speeds of the drawing paddles 131 and the drawing belt roller 158 will be described with reference to FIG. 12. FIG. 12 illustrates the positional relationship when the movement of the sheets S1 and S2 is started by the drawing paddles 131 and the drawing belt roller 158. Further, FIG. 12 shows a distance a from the stacked upper sheet S2 to the position where the drawing belt roller 158 abuts on the sheet (equal to the displaced amount between the sheet S1 and the sheet S2), and a distance b from the position where the drawing belt roller 158 abuts on the sheet to the trailing edge stopper 150.

Further, FIG. 12 shows the sheet moving speed Vp of the drawing paddles 131, and the sheet moving speed Vb of the drawing belt roller 158. Thus, the time taken to draw and move the lower sheet S1 to the trailing edge stopper 150 by the drawing belt roller 158 is t=b/Vb, and the time taken to draw and move the upper sheet S2 to the position where the drawing belt roller 158 abuts on the sheet, is t=a/Vp.

In the present exemplary embodiment, the upper sheet S2 is moved to the position where the drawing belt roller 158 abuts on the sheet, after the lower sheet S1 is conveyed to the trailing edge stopper 150. In order to realize that processing, it is required that the upper sheet S2 should be prevented from being moved to the position where the drawing belt roller 158 abuts on the sheet before the lower sheet S1 is drawn and moved to the trailing edge stopper 150. In other words, it is required to satisfy the relationship ($b/Vb \leq a/Vp$). For this purpose, the moving speed Vp of the drawing paddles 131 is set so as to satisfy the relationship ($Vp \leq Vb \times a/b$). The moving speed Vp does not have to be a constant speed, and the Vp may be set such that an average speed Vpav during the time ($t=b/Vb$) satisfies the relationship ($Vpav \leq Vb \times a/b$).

Further, as long as the productivity can meet the required level, the drawing paddles 131 may be temporarily stopped, and the drawing paddles 131 may be driven to transfer the upper sheet S2 to the drawing belt roller 158 after the lower sheet S1 reaches the trailing edge stopper 150.

Next, the buffering processing by the finisher control unit 636 according to the present exemplary embodiment will be described with reference to the flowchart of FIG. 13. In step S800, the conveyance of buffered sheets is started. First, in step S801, HP movement processing is performed. As illustrated in FIG. 14, during the HP movement processing, first, in step S820, the finisher control unit 636 drives the trailing edge drop member driving motor M160 to move the trailing edge drop member 160 toward its home position. After that, in step S821, the finisher control unit 636 monitors the trailing edge drop member HP sensor 162. Then, in step S822, the finisher control unit 636 determines whether the trailing edge drop member 160 has reached the trailing edge drop member home position (HP). If the finisher control unit 636 determines that the trailing edge drop member 160 has reached the trailing edge drop member HP (YES in step S822), in step S823, the finisher control unit 636 stops the trailing edge drop member driving motor M160.

Next, in step S824, the finisher control unit 636 drives the drawing paddle driving motor M131 to move the drawing paddles 131 toward their home positions. After that, in step S825, the finisher control unit 636 monitors the drawing paddle HP sensor 161. Then, in step S826, the finisher control unit 636 determines whether the drawing paddles 131 have reached the drawing paddle HPs. If the finisher control unit 636 determines that the drawing paddles 131 have reached the drawing paddle HPs (YES in step S826), in step S827, the finisher control unit 636 stops the drawing paddle driving motor M131.

Next, in step S828, the finisher control unit 636 drives the alignment member motors M240 to move the alignment members 240 toward their home positions. After that, in step S829, the finisher control unit 636 monitors the alignment member HP sensors 243. Then, in step S830, the finisher control unit 636 determines whether the alignment members 240 have reached the alignment member HPs. If the finisher control unit 636 determines that the alignment members 240 have reached the alignment member HPs (YES in step S830), in step S831, the finisher control unit 636 stops the alignment member motors M240.

Lastly, in step S832, the finisher control unit 636 drives the pulling member driving motor M180 to move the pulling member 180 toward its retracting position. After that, in step S833, the finisher control unit 636 monitors the pulling member position sensor. Then, in step S834, the finisher control unit 636 determines whether the pulling member 180 has reached its retracting position. If the finisher control unit 636 determines that the pulling member 180 has reached its retracting position (YES in step S834), in step S835, the finisher control unit 636 stops the pulling member driving motor M180. Then, in step S836, the HP movement processing is ended.

Figure 13:
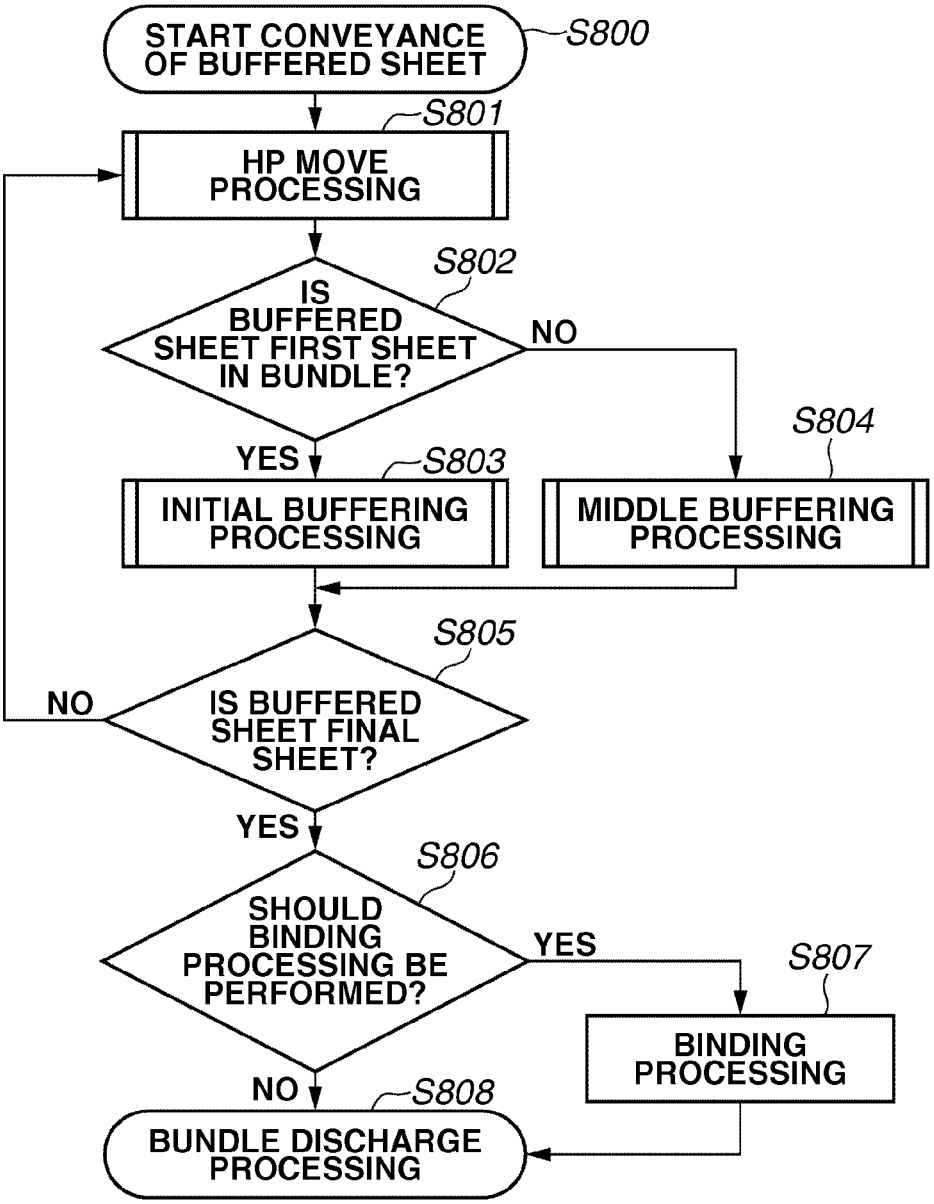
FIG. 13 is a flowchart illustrating buffering processing by the above-described finisher.
Figure 14:
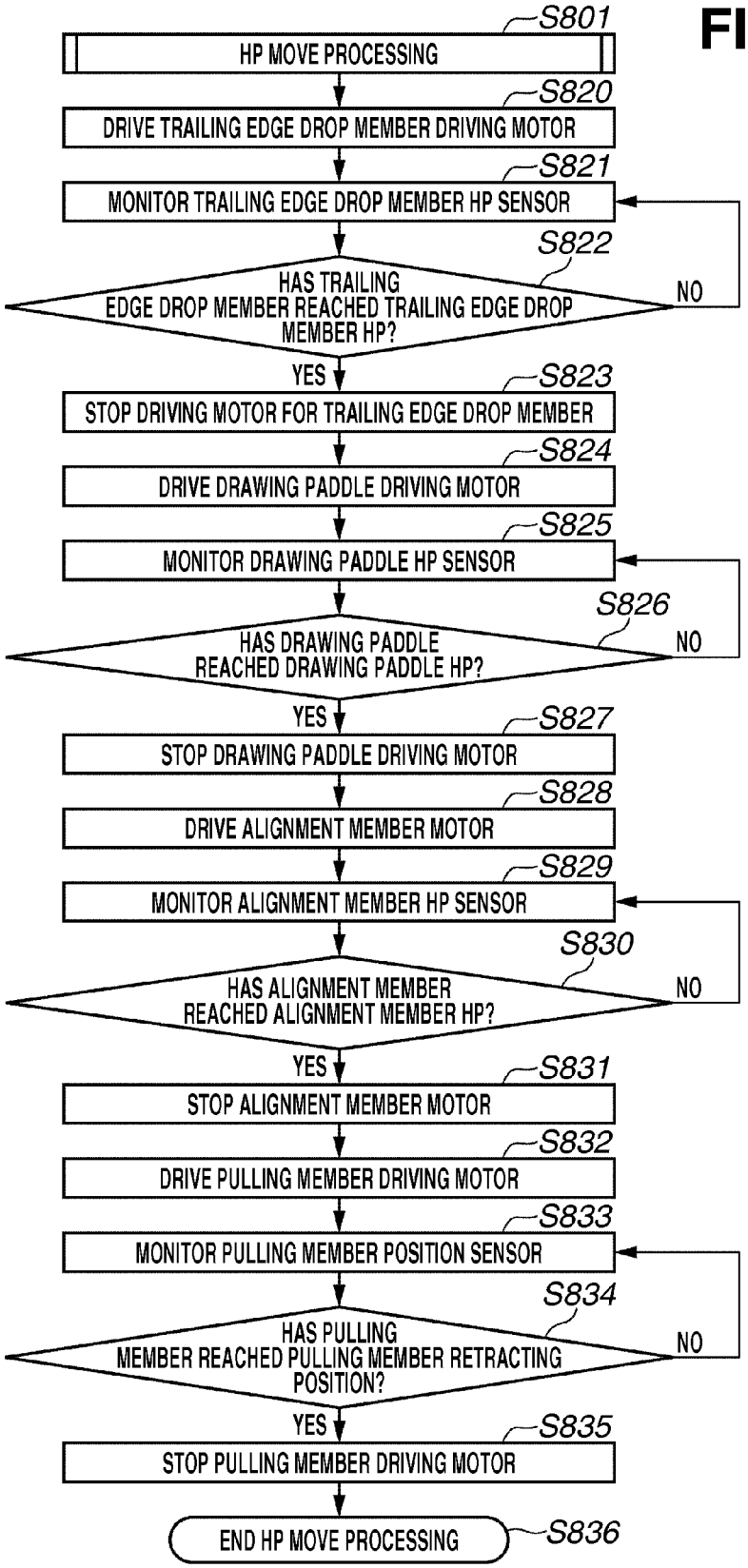
FIG. 14 is a flowchart illustrating home position (HP) movement processing in the above-described buffering processing.

Upon the end of this HP movement processing, as illustrated in FIG. 13, in step S802, the finisher control unit 636 determines whether the conveyed buffered sheets are the first sheets in a bundle, based on the information transmitted from the CPU 629 of the copying machine main body. For example, if the conveyed buffered sheets are the first sheets in a bundle (YES in step S802), in step S803, the initial buffering processing is started.

Figure 15:
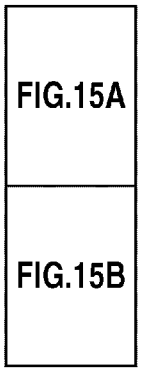
FIG. 15, including
Figure 15A:
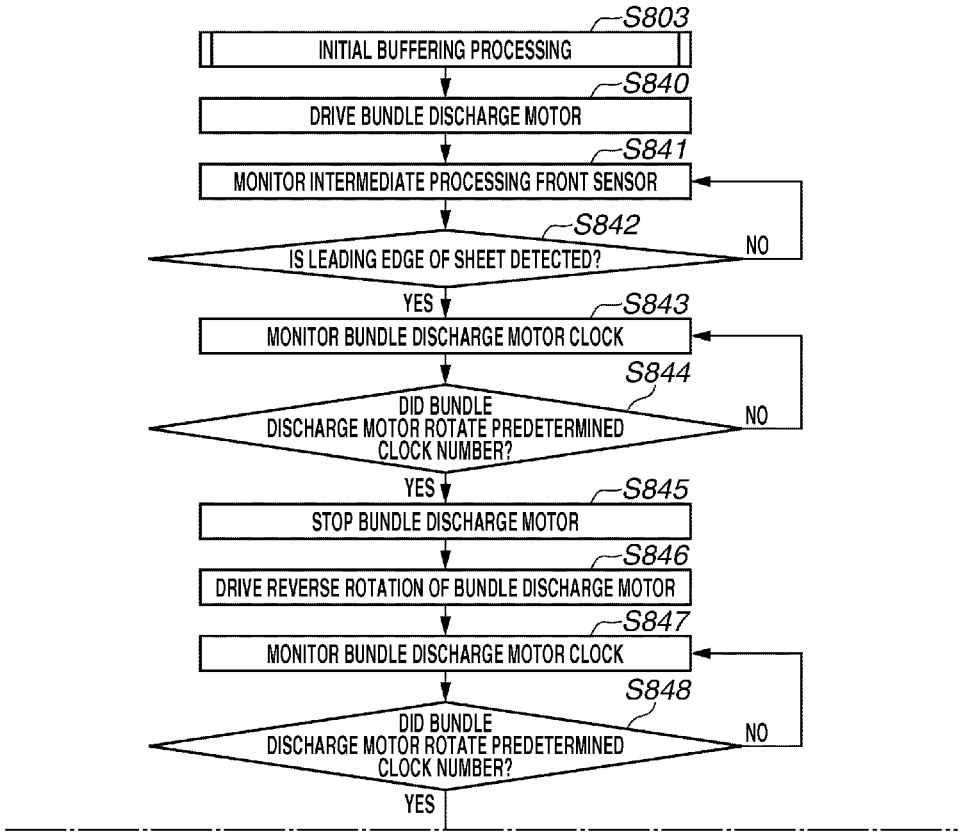
FIG. 15A and FIG. 15B, is a flowchart illustrating the initial buffering processing in the above-described buffering processing.
Figure 15B:
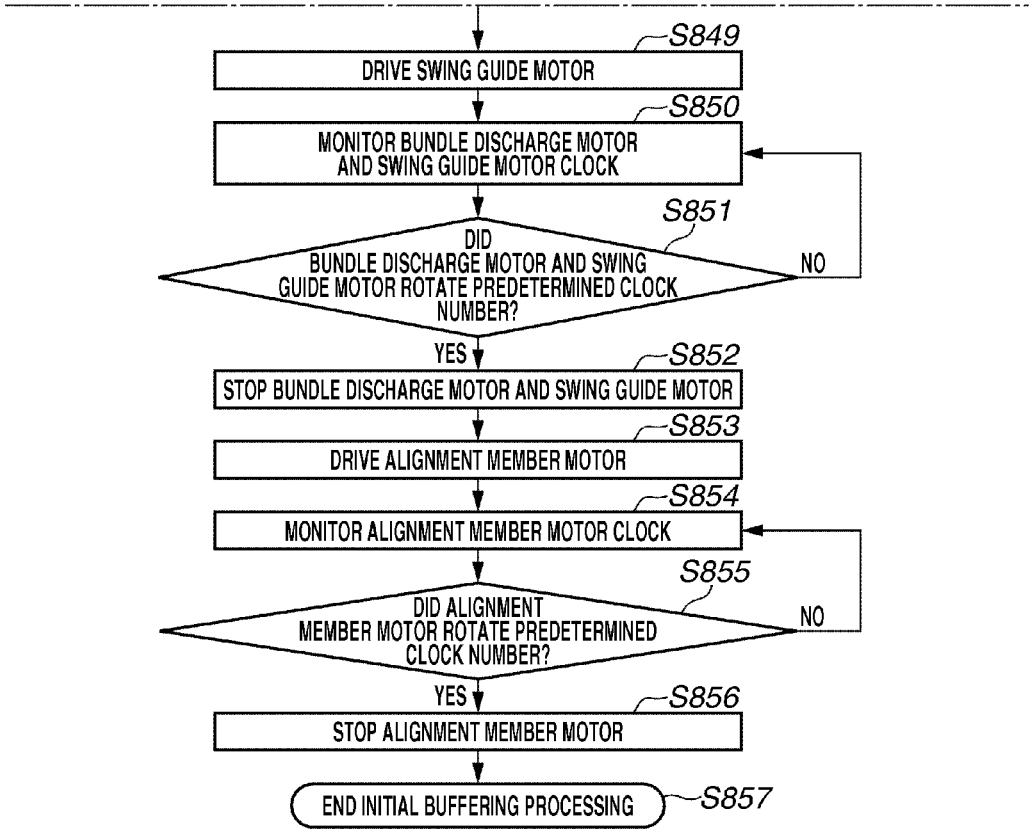

As illustrated in FIG. 15, during the initial buffering processing, first, in step S840, the finisher control unit 636 drives the bundle discharge motor M130 to rotate the bundle discharge roller pair 130, thereby preparing for the sheet introduction. Next, in step S841, the finisher control unit 636 monitors the intermediate processing front sensor 127 to detect the timing when the initial buffered sheets start to be conveyed to the intermediate processing tray 138. After that, if the intermediate processing front sensor 127 detects the leading edges of the sheets (YES in step S842), in step S843, the finisher control unit 636 monitors (counts) the clock number of the bundle discharge motor M130 based on the detected timing.

Next, in step S844, after the detected initial buffered sheets are transferred from the lower discharge roller pair 128 to the bundle discharge roller pair 130 as illustrated in above-described FIGS. 8A and 8B, the finisher control unit 636 determines whether the bundle discharge motor M130 has rotated the number of times corresponding to a predetermined clock number, which indicates that the initial buffered sheets have exited the lower discharge roller pair 128. If the finisher control unit 636 determines that the bundle discharge motor M130 has rotated the number of times corresponding to the predetermined clock number (YES in step S844), i.e., the initial buffered sheets S have exited the lower discharge roller pair 128 as illustrated in above-described FIG. 8C, in step S845, the finisher control unit 636 temporarily stops the bundle discharge motor M130.

Next, as illustrated in above-described FIG. 9A, in step S846, the finisher control unit 636 drives the bundle discharge motor M130 to rotate in the reverse direction. Further, in step S847. The finisher control unit 636 monitors the clock number of the bundle discharge motor M130. After that, if the finisher control unit 636 determines that the bundle discharge motor M130 has rotated the number of times corresponding to a predetermined clock number (YES in step S848), i.e., the finisher control unit 636 determines that the initial buffered sheets S are moved toward the trailing edge stopper 150 by a predetermined distance, in step S849, the finisher control unit 636 drives the swing guide motor M149. As a result, as illustrated in above-described FIG. 9B, the swing guide 149 is rotated upwardly so as to separate the bundle discharge rollers 130*a* and 130*b*.

After that, in step S850, the finisher control unit 636 monitors the clock numbers of the bundle discharge motor M130 and the swing guide motor M149. Then, if the finisher control unit 636 determines that the bundle discharge motor M130 and the swing guide motor M149 each have rotated the number of times corresponding to a predetermined clock number (YES in step S851), i.e., the alignment of the sheets S is completed as illustrated in above-described FIG. 9C, in step S852, the finisher control unit 636 stops the bundle discharge motor M130 and the swing guide motor M149.

Next, in step S853, the finisher control unit 636 drives the alignment member motors M240 to align the initial buffered sheets S in the width direction. Further, in step S854, the finisher control unit 636 monitors the clock numbers of the alignment member motors M240. After that, if the finisher control unit 636 determines that the alignment member motors M240 each have rotated the number of times corresponding to a predetermined clock number (YES in step S855), i.e., the finisher control unit 636 determines that the processing for aligning the sheets in the sheet width direction is completed, in step S856, the finisher control unit 636 stops the alignment member motors M240. Then, in step S857, the initial buffering processing is ended.

Figure 16:
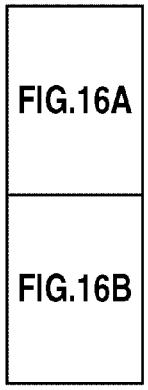
FIG. 16, including
Figure 16A:
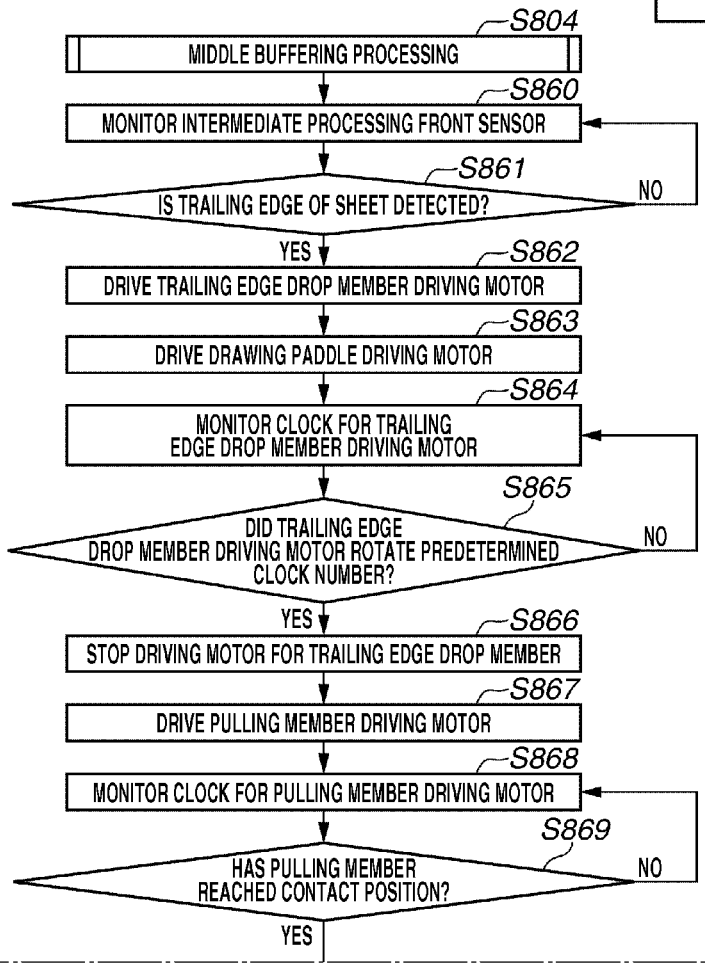
FIG. 16A and FIG. 16B, is a flowchart illustrating the middle buffering processing in the above-described buffering processing.
Figure 16B:
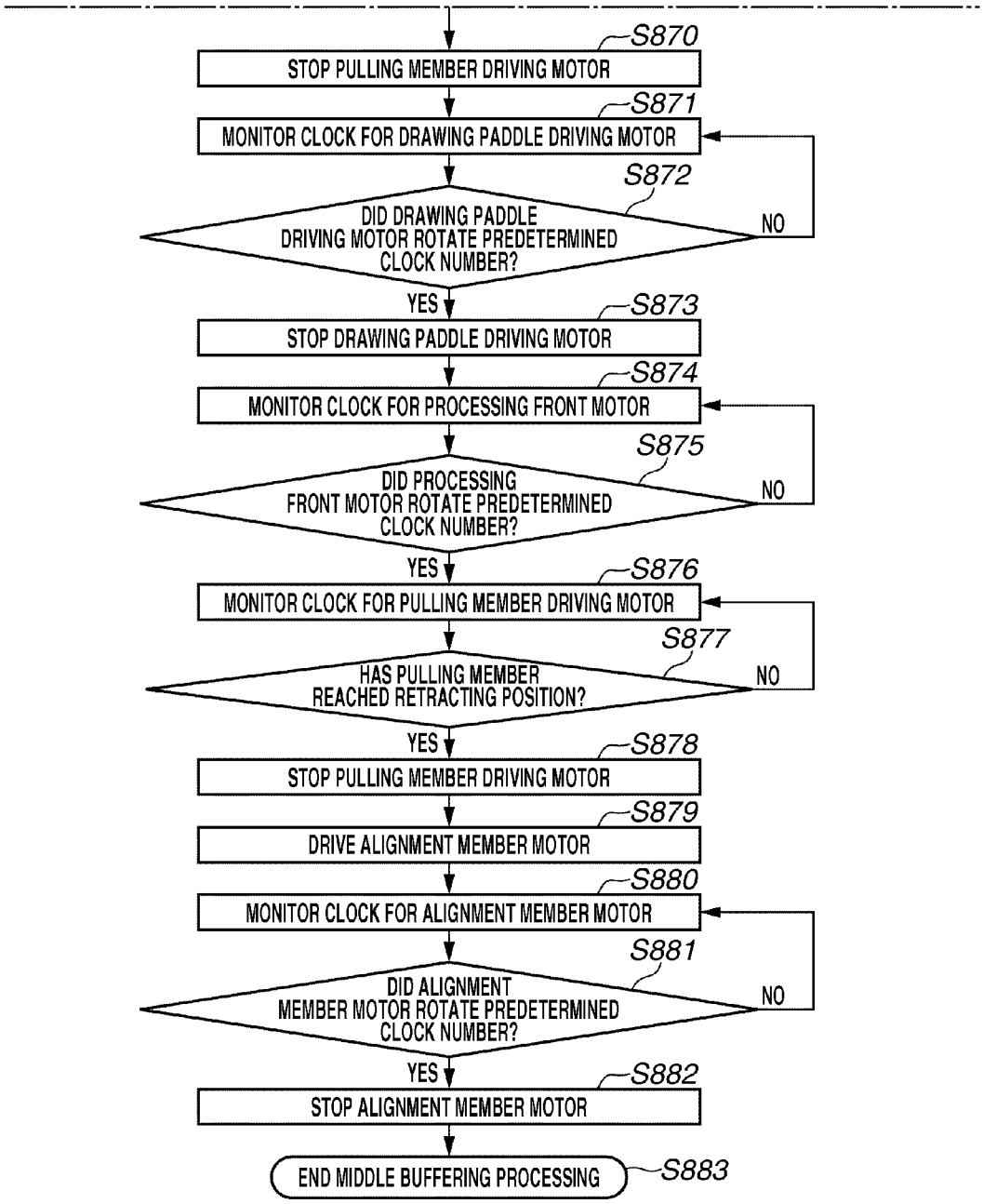

On the other hand, if the conveyed buffered sheets are not the first sheets (NO in step S802), in step S804, the middle buffering processing is started. As illustrated in FIG. 16, during the middle buffering processing, first, in step S860, the finisher control unit 636 monitors the intermediate processing front sensor 127 to detect the timing when the trailing edges of the middle buffered sheets exit the lower discharge roller pair 128. Then, if the intermediate processing front sensor 127 detects the trailing edges of the middle buffered sheets (YES in step S861), in step S862, the finisher control unit 636 drives the trailing edge drop member driving motor M160 when the trailing edges of the middle buffered sheets exit the lower discharge roller pair 128. As a result, as illustrated in above-described FIG. 10B, the trailing edge drop member 160 hits the middle buffered sheets S' down to the intermediate processing tray 138 when the trailing edges of the middle buffered sheets S' exit the lower discharge roller pair 128.

Next, in step S863, after the middle buffered sheets S' are hit down onto the intermediate processing tray 138, the finisher control unit 636 drives the drawing paddle driving motor M131. After that, in step S864, the finisher control unit 636 monitors the clock number of the trailing edge drop member driving motor M160. If the trailing edge drop member driving motor M160 has rotated the number of times corresponding to a predetermined clock number (YES in step S865), in step S866, the finisher control unit 636 stops the trailing edge drop member driving motor M160.

Next, in step S867, the finisher control unit 636 drives the pulling member driving motor M180 when the middle buffered sheets S' are dropped onto the intermediate processing tray 138 to move the drawing belt roller 158 in the direction abutting on the middle buffered sheets S'. After that, instep S868, the finisher control unit 636 monitors the clock number of the pulling member driving motor M180. Then, if the finisher control unit 636 determines that the pulling member driving motor M180 has rotated the number of times corresponding to a predetermined clock number (YES in step S869), i.e., the finisher control unit 636 determines that the drawing belt roller 158 has reached the contact position as illustrated in above-described FIG. 10C, in step S870, the finisher control unit 636 stops the pulling member driving motor M180. After that, when the drawing belt roller 158 is rotated according to a rotation of the lower discharge roller 128*a*, the lower sheet S1 is moved toward the trailing edge stopper 150.

Next, in step S871, the finisher control unit 636 monitors the clock number of the drawing paddle driving motor M131 driven in step S863. The drawing paddle driving motor M131 is controlled to rotate the number of times corresponding to a predetermined clock number in a predetermined time so that the upper sheet S2 is transferred to the drawing belt roller 158 as illustrated in above-described FIG. 11A after the lower sheet S1 reaches the trailing edge stopper 150. If the drawing paddle driving motor M131 has rotated the number of times corresponding to the predetermined clock number (YES in step S872) so that the upper sheet S2 is transferred to the drawing belt roller 158 after the lower sheet S1 reaches the trailing edge stopper 150, in step S873, the finisher control unit 636 stops the drawing paddle driving motor M131.

Next, in step S874, the finisher control unit 636 drives the processing front motor M128, and monitors the clock number of the processing front motor M128. Then, if the finisher control unit 636 determines that the processing front motor M128 has rotated the number of times corresponding to a predetermined clock number (YES in step S875), i.e., the finisher control unit 636 determines that the processing front motor M128 has rotated by a predetermined distance which causes the transferred sheets to abut on the trailing edge stopper 150, driven by the drawing belt roller 158, the finisher control unit 636 drives the pulling member driving motor M180.

Next, in step S876, as illustrated in above-described FIG. 11B, the finisher control unit 636 monitors the clock number of the pulling member driving motor M180 after the transferred sheet S2 abuts on the trailing edge stopper 150. Then, in step S877, the finisher control unit 636 determines whether the pulling member 163 has reached the retracting position of the puling member 163, which causes the drawing belt roller 158 to return to the retracting position of the drawing belt roller 158. If the finisher control unit 636 determines that the pulling member 163 has reached the retracting position (YES in step S877), in step S878, the finisher control unit 636 stops the pulling member driving motor M180.

Next, after the pulling member 163 has reached the retracting position to complete the return of the drawing belt roller 158 to the retracting position, in step S879, the finisher control unit 636 drives the alignment member motors M240. In step S880, the finisher control unit 636 monitors the clock numbers of the alignment member motors M240. Then, if the finisher control unit 636 determines that the alignment member motors M240 each have rotated the number of times corresponding to a predetermined clock number (YES in step S881) so that the sheets are aligned by the alignment members 240, in step S882, the finisher control unit 636 stops the alignment member motors M240. Then, in step S883, the middle buffering processing is ended.

Next, after the initial buffering processing or the middle buffering processing is ended in this way, in step S805, the finisher control unit 636 determines whether the aligned sheets are the final sheets in the bundle based on the information transmitted from the CPU 629 in the copying machine main body. If the sheets are not the final sheets (NO in step S805), the processing proceeds to step S801 again. In step S801, the HP movement processing is performed. Then, the above-described processing is repeated.

On the other hand, if the sheet is the final sheet (YES in step S805), in step S806, the finisher control unit 636 determines whether the binding processing should be performed. If the binding processing should be performed (YES in step S806), in step S807, the binding processing is performed. After that, in step S808, the bundle discharge processing is performed, and then the processing is ended. If the binding processing is not to be performed (NO in step S806), in step S808, the bundle discharge processing is performed without execution of the binding processing, and then the processing is ended.

As mentioned above, in the present exemplary embodiment, the initial buffering processing is performed on the first several sheets in a sheet bundle, and the middle buffering processing is performed on the subsequent sheets. Then, after the middle buffered sheets, which are processed by the middle buffering processing, are conveyed to the intermediate processing tray 138, the middle buffered sheets are sequentially moved by the drawing belt roller 158, starting from the lowermost sheet, so as to be abutted against the trailing edge stopper 150. Further, the drawing paddles 131, which draw a sheet to move the sheet to the drawing belt roller 158, are driven in such a manner that, until the moved lowermost sheet abuts on the trailing edge stopper 150, the next sheet does not reach the drawing belt roller 158.

In other words, in the present exemplary embodiment, until the lower sheet abuts on the trailing edge stopper 150, the next sheet is prevented from reaching the drawing belt roller 158, thereby ensuring that the sheets are sequentially abutted against the trailing edge stopper 150, starting from the lowermost sheet. Further, when the middle buffered sheets are abutted against the trailing edge stopper 150, the moving force is applied around the trailing edges of the buffered sheets. This arrangement ensures that a plurality of stacked sheets can be aligned even when there is a conveyance error or a variation in the lengths of the sheets in the conveyance direction.

As a result, even if the copying machine main body 602 forms images at a highspeed and discharges sheets at short intervals, it is possible to perform processing such as alignment processing on the sheets without slowing down the image formation speed of the copying machine main body 602. Further, during the middle buffered processing, at least two or more sheets are conveyed in a stacked state, thereby reducing the alignment operation to half or less compared to the conventional technique which conveys sheets one by one, and allowing a reduction in the operation speed. As a result, it is possible to improve the durability of the alignment members, and to reduce loads to the driving motors, leading to miniaturization and cost-reduction of the motors.

Further, at least two values may be prepared for the number of sheets to be stacked as the initial buffered sheets to allow a change in the number of sheets to be stacked as the initial buffered sheets according to the number of sheets in a sheet bundle, so as to make a number of subsequent sheets a multiple number of sheets to be stacked as the middle buffered sheets. This arrangement can prevent such a situation that the final sheet in a bundle cannot be stacked, which makes it impossible to form the middle buffered sheets.

The present exemplary embodiment has been described based on the finisher 100 using the switchback method, according to which a sheet is conveyed in the reverse direction in the middle of conveyance to be temporarily kept waiting in the waiting path (the buffer path 113). However, embodiments are not limited thereto. For example, embodiments can be applied to a finisher using a wrapping method illustrated in FIG. 17A or a finisher using a multiple buffer path method illustrated in FIG. 17B.

Figure 17A:
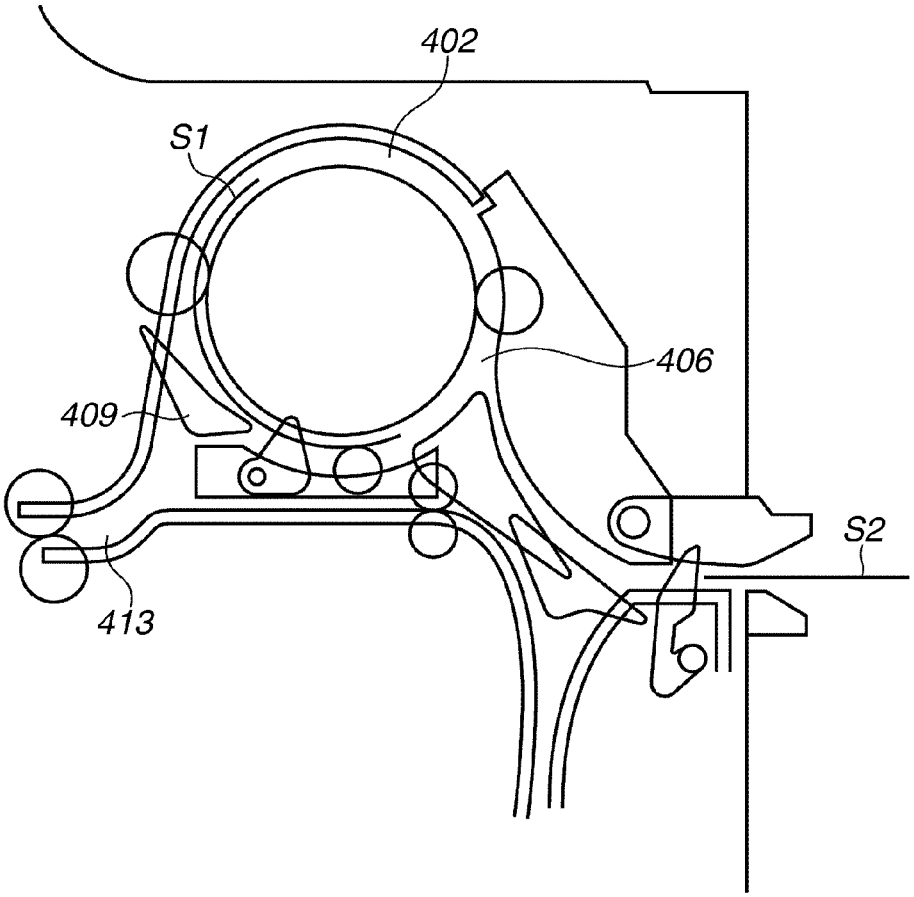
FIGS. 17A and 17B each illustrate another configuration of the above-described finisher.

The finisher using the wrapping method functions in the following manner. When a sheet is buffered, as illustrated in FIG. 17A, first, the prior sheet S1 is temporarily kept waiting in a circular path 402 formed along a circumferential surface of a buffer roller 410, which is a rotator. Then, in synchronization with conveyance of the subsequent sheet S2, the waiting sheet S1 is conveyed to be stacked at a junction point 406. This processing is repeated for a required number of sheets. When the stacking of the required number of sheets is completed, a conveyance path switching member 409 is switched and the stacked sheet bundle is conveyed by a conveyance roller pair 411 disposed at a bundle conveyance path 413.

Figure 17B:
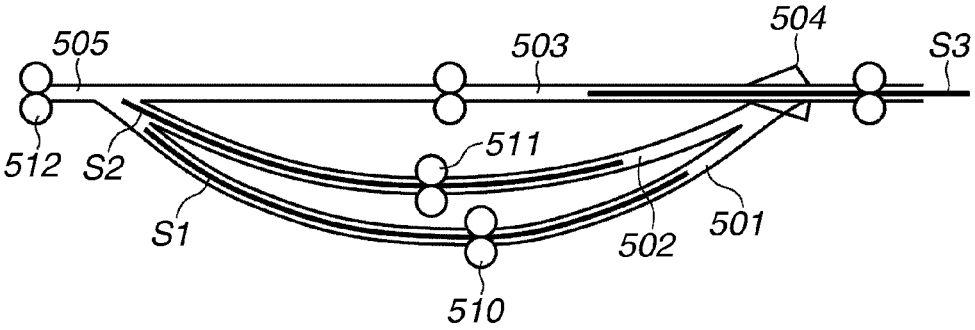

Further, the finisher using the multiple buffer path method functions in the following manner. As illustrated in FIG. 17B, sheets are stacked by using buffer paths corresponding to the number of sheets to be stacked. This method will be described now based on an example in which three sheets are stacked. When sheets are conveyed, a first prior sheet S1 and a second prior sheet S2 are guided to a first buffer path 501 and a second buffer path 502 by using a path switching member 504, respectively, and are temporarily kept waiting therein.

After that, when a final sheet S3 among sheets to be stacked is transmitted through a third buffer path 503 to exit a junction path 505, a conveyance roller pair 510 disposed at the first buffer path 501 and a conveyance roller pair 511 disposed at the second buffer path 502 are driven. As a result, the sheets S1 and S2 waiting in the first and second buffer paths 501 and 502 are stacked on the first sheet S3 at the junction path 505. After that, the three sheets S1 to S3 are conveyed by a conveyance roller pair 512 in a stacked state. Even in a case where a larger number of sheets are stacked, a similar operation is performed by preparing buffer paths corresponding to the number of sheets to be stacked, guiding the sheets to the respective buffer paths, keeping the sheets waiting, and conveying the sheets in synchronization with conveyance of the final sheet to be stacked to combine them all.

Figure 18:
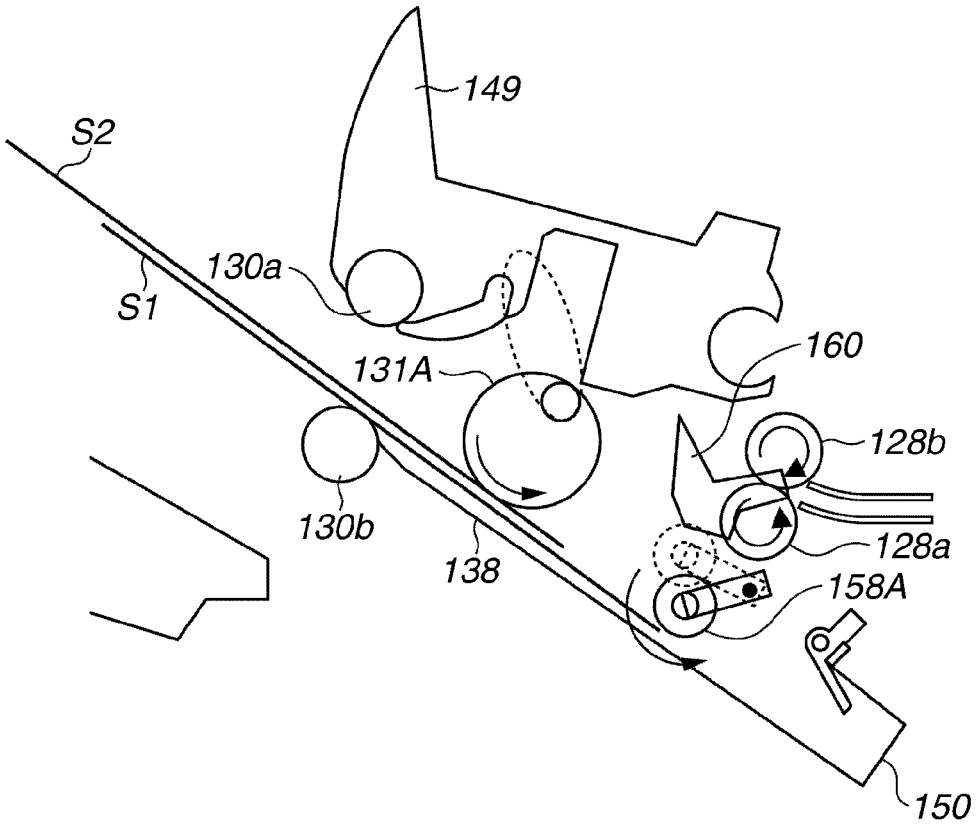
FIG. 18 illustrates the configuration of a stapler unit of a finisher according to a second exemplary embodiment.

Next, a second embodiment will be described. FIG. 18 illustrates the configuration of a stapler unit of a finisher according to the present exemplary embodiment. In FIG. 18, the same reference numerals as those in above-described FIG. 12 indicate the same or similar portions or units.

In FIG. 18, a drawing roller 158A is the first moving unit. The drawing roller 158A is vertically disposed rotatably above the intermediate processing tray 138 and substantially right below the lower discharge roller 128*a*. The drawing roller 158A can contact and separate from a sheet placed on the intermediate processing tray 138, and can be located at a contact position (the position indicated by the solid line), in which the drawing roller 158A is in contact with a sheet, and a retracting position (the position indicated by the broken line), in which the drawing roller 158A is not in contact with a sheet. Then, when the drawing roller 158A is located at the contact position, the drawing roller 158A draws the sheet on the intermediate processing tray 138 to move it toward the trailing edge stopper 150.

Further, a drawing belt roller 131A is the second moving unit. The drawing belt roller 131A is disposed above the intermediate processing tray 138 and downstream of the drawing roller 158A in the sheet discharge direction (upstream in the moving direction). The drawing belt roller 131A can contact and separate from a sheet placed on the intermediate processing tray 138, and can be located at a contact position (the position indicated by the solid line), in which the drawing belt roller 131A is in contact with a sheet, and a retracting position (the position indicated by the broken line), in which the drawing belt roller 131A is not in contact with a sheet. When the drawing belt roller 131A is located at the contact position, the drawing belt roller 131A draws the sheet on the intermediate processing tray 138 to move it toward the drawing roller 158A.

In the present exemplary embodiment, the drawing belt roller 131A and the drawing roller 158A have functions corresponding to the drawing paddles 131 and the drawing belt roller 158 in the above-described first exemplary embodiment, respectively. More specifically, for the middle buffered sheets released onto the intermediate processing tray 131, the drawing roller 158A has a function of moving a sheet to the trailing edge stopper 150. Further, the drawing belt roller 131A has a function of transferring an upper sheet to the drawing roller 158A after a lower sheet reaches the trailing edge stopper 150.

Then, after the middle buffered sheets are conveyed to the intermediate processing tray 138, the sheets are sequentially moved by the drawing roller 158A, starting from the lowermost sheet, to be abutted against the trailing edge stopper 150. Further, the drawing belt roller 131A, which draws a sheet to move it to the drawing roller 158A, is driven in such a manner that, until a moved sheet abuts on the trailing edge stopper 150, the next sheet does not reach the drawing roller 158A. As a result, it is possible to ensure that the plurality of stacked sheets can be aligned even if there is a conveyance error or a variation in the lengths of sheets in the conveyance direction.

In the present exemplary embodiment, the second moving unit, which corresponds to the drawing paddles 131 capable of moving to the contact position and the retracting position while rotating in the above-described first exemplary embodiment, is embodied by a belt roller which is an endless belt capable of moving to the contact position and the retracting position while deforming. However, the present invention is not limited thereto.

This drawing member may be realized by any member capable of moving a sheet and capable of contacting and separating from the sheet. The drawing member may be realized by a conveyance roller vertically movable to the contact position and the retracting position, like the drawing roller 158A. Similarly, the first moving unit corresponding to the drawing belt roller 158 in the first exemplary embodiment, which sequentially draws conveyed sheets, starting from the lowermost sheet, may be also realized by any unit capable of moving a sheet and capable of contacting and separating from the sheet. The first moving unit may be realized by a paddle, like the drawing paddle 131. In other words, the first moving unit and the second moving unit may be constituted by any one of an endless belt, a paddle, and a roller.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-216976 filed Sep. 30, 2011, and No. 2012-193981 filed Sep. 4, 2012, which is hereby incorporated by reference herein in its entirety.

What is claimed is:

1. A sheet processing apparatus comprising:

a sheet stacking unit where sheets to be processed are stacked;

a regulating member configured to abut on one edge of sheets conveyed to the sheet stacking unit in a sheet conveyance direction to regulate position of a sheet in the sheet conveyance direction;

a sheet waiting unit configured to keep sheets waiting, stack the waiting sheets displaced sequentially so that a lower sheet will be positioned closer to the regulating member than an upper sheet after the displaced sheets are conveyed to the sheet stacking unit, and then convey the displaced sheets to the sheet stacking unit;

a first moving unit configured to sequentially move the sheets conveyed to the sheet stacking unit, starting from a lowermost sheet, to be abutted against the regulating member;

a second moving unit disposed upstream of the first moving unit in a moving direction, and configured to move the sheets conveyed to the sheet stacking unit to the first moving unit; and a control unit configured to control the second moving unit to move a next sheet so that the next sheet does not reach the first moving unit until after the sheet moved by the first moving unit is abutted against and stopped by the regulating member.

2. The sheet processing apparatus according to claim 1, wherein the control unit controls a moving speed of the second moving unit so that the next sheet moved by the second moving unit does not reach the first moving unit until the sheet moved by the first moving unit is abutted against the regulating member.

3. The sheet processing apparatus according to claim 1, wherein the control unit controls the first moving unit and the second moving unit so that a moving speed of the second moving unit is lower than a moving speed of the first moving unit.

4. The sheet processing apparatus according to claim 1, wherein the first moving unit and the second moving unit are movable to a contact position, where the first moving unit or the second moving unit is in contact with the sheets conveyed to the sheet stacking unit, and to a retracting position, where the first moving unit or the second moving unit is not in contact with the sheets, and wherein the first moving unit or the second moving unit is moved to the contact position in response to the sheets being conveyed to the sheet stacking unit, and is moved to the retracting position after all of the sheets conveyed to the sheet stacking unit are moved into contact with the regulating member.

5. The sheet processing apparatus according to claim 4, wherein the second moving unit is moved from the retracting position to the contact position in response to the sheets being conveyed to the sheet stacking unit.

6. The sheet processing apparatus according to claim 4, wherein each of the first moving unit and the second moving unit comprises any one of: an endless belt that moves to the contact position and the retracting position while deforming, a paddle that moves to the contact position and the retracting position while rotating, and a roller vertically movable to the contact position and the retracting position.

7. The sheet processing apparatus according to claim 4, further comprising a width direction alignment unit configured to align the sheets in a width direction perpendicular to a sheet discharge direction, after the sheets stacked on the sheet stacking unit are conveyed into contact with the regulating member.

8. The sheet processing apparatus according to claim 1, wherein the control unit coordinates movement of the next sheet by the second moving unit with movement of a sheet by the first moving unit so that the next sheet does not reach the first moving unit until after the sheet moved by the first moving unit is abutted against and stopped by the regulating member.

9. The sheet processing apparatus according to claim 1, wherein the sheet waiting unit is configured to keep sheets waiting and then convey the sheets to the sheet stacking unit, wherein, in response to first plural sheets being conveyed to the sheet stacking unit, the sheet waiting unit keeps subsequent sheets waiting by receiving a first sheet and sequentially accumulating each subsequent sheet in a displaced arrangement so that a lower sheet of second plural sheets will be located on the sheet stacking unit at a position that is closer to the regulating member than an upper sheet, and then, while maintaining sheet displacement, conveys the displaced second plural sheets to the sheet stacking unit having the first plural sheets.

10. An image forming apparatus comprising:

an image forming unit configured to form an image on a sheet; and the sheet processing apparatus according to claim 1 configured to process the sheet with the image formed thereon by the image forming unit.

11. An image forming apparatus comprising:

an image forming unit configured to form an image on a sheet;

a control unit configured to control a sheet processing apparatus; and the sheet processing apparatus, wherein the sheet processing apparatus is configured to process the sheet with the image formed thereon by the image forming unit and includes:

a sheet stacking unit where sheets to be processed are stacked, a regulating member configured to abut on one edge of sheets conveyed to the sheet stacking unit in a sheet conveyance direction to regulate position of the sheet in the sheet conveyance direction, a sheet waiting unit configured to keep sheets waiting, stack the waiting sheets displaced sequentially so that a lower sheet will be positioned closer to the regulating member than an upper sheet after the displaced sheets are conveyed to the sheet stacking unit, and then convey the displaced sheets to the sheet stacking unit, a first moving unit configured to sequentially move the sheets conveyed to the sheet stacking unit, starting from a lowermost sheet, to be abutted against the regulating member, and a second moving unit disposed upstream of the first moving unit in a moving direction, and configured to move the sheets conveyed to the sheet stacking unit to the first moving unit, wherein the control unit controls the second moving unit to move a next sheet so that the next sheet does not reach the first moving unit until after the sheet moved by the first moving unit is abutted against and stopped by the regulating member.

12. The image forming apparatus according to claim 11, wherein the control unit controls a moving speed of the second moving unit so that the next sheet moved by the second moving unit does not reach the first moving unit until the sheet moved by the first moving unit is abutted against the regulating member.

13. The image forming apparatus according to claim 11, wherein the control unit controls the first moving unit and the second moving unit so that a moving speed of the second moving unit is lower than a moving speed of the first moving unit.

14. The image forming apparatus according to claim 11, wherein the first moving unit and the second moving unit are movable to a contact position, where the first moving unit or the second moving unit is in contact with the sheets conveyed to the sheet stacking unit, and to a retracting position, where the first moving unit or the second moving unit is not in contact with the sheets, and wherein the first moving unit or the second moving unit is moved to the contact position in response to the sheets being conveyed to the sheet stacking unit, and is moved to the retracting position after all of the sheets conveyed to the sheet stacking unit are moved into contact with the regulating member.

15. The image forming apparatus according to claim 14, wherein the second moving unit is moved from the retracting position to the contact position in response to the sheets being conveyed to the sheet stacking unit.

16. The image forming apparatus according to claim 14, wherein each of the first moving unit and the second moving unit comprises any one of: an endless belt that moves to the contact position and the retracting position while deforming, a paddle that moves to the contact position and the retracting position while rotating, and a roller vertically movable to the contact position and the retracting position.

17. The image forming apparatus according to claim 14, wherein the sheet processing apparatus further includes a width direction alignment unit configured to align the sheets in a width direction perpendicular to a sheet discharge direction, after the sheets stacked on the sheet stacking unit are conveyed into contact with the regulating member.

18. A method for a sheet processing apparatus, wherein the sheet processing apparatus includes a sheet stacking unit where sheets to be processed are stacked, a regulating member configured to abut on one edge of sheets conveyed to the sheet stacking unit in a sheet conveyance direction to regulate position of a sheet in the sheet conveyance direction, a sheet waiting unit, a first moving unit, a second moving unit disposed upstream of the first moving unit in a moving direction, and a control unit, the method comprising:

keeping sheets waiting, using the sheet waiting unit, by sequentially displacing the sheets received by the sheet waiting unit so that a lower sheet will be positioned closer to the regulating member than an upper sheet after the displaced sheets are conveyed to the sheet stacking unit, and then conveying the displaced sheets to the sheet stacking unit;

sequentially moving the sheets conveyed to the sheet stacking unit using the first moving unit, starting from a lowermost sheet, to be abutted against the regulating member;

moving the sheets conveyed to the sheet stacking unit to the first moving unit using the second moving unit; and controlling, using the control unit, the second moving unit to move a next sheet so that the next sheet does not reach the first moving unit until after the sheet moved by the first moving unit is abutted against the regulating member.

* * * * *